US008637163B2

(12) United States Patent
Tokuda et al.

(10) Patent No.: US 8,637,163 B2
(45) **Date of Patent: *Jan. 28, 2014**

(54) ALLOY WITH HIGH GLASS FORMING ABILITY AND ALLOY-PLATED METAL MATERIAL USING SAME

(75) Inventors: Kohei Tokuda, Tokyo (JP); Koichi Nose, Tokyo (JP); Yuichi Sato, Tokyo (JP); Makoto Nakazawa, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/309,391

(22) PCT Filed: Jul. 19, 2007

(86) PCT No.: PCT/JP2007/064617

§ 371 (c)(1),
(2), (4) Date: Jan. 14, 2009

(87) PCT Pub. No.: WO2008/010603

PCT Pub. Date: Jan. 24, 2008

(65) Prior Publication Data

US 2009/0246070 A1 Oct. 1, 2009

(30) Foreign Application Priority Data

Jul. 19, 2006 (JP) ..... 2006-196902
Feb. 19, 2007 (JP) ..... 2007-038444

(51) Int. Cl.
*B32B 15/00* (2006.01)
*B32B 15/18* (2006.01)
*C22C 18/00* (2006.01)

(52) U.S. Cl.
USPC ..... 428/659; 420/408; 420/411; 420/513; 420/514; 420/515; 420/516; 428/615

(58) Field of Classification Search
USPC ..... 420/402, 407, 408, 411, 513–516, 420/518–522, 528, 540–542, 547; 428/615, 428/650–659
See application file for complete search history.

(56) References Cited

U.S. PATENT DOCUMENTS 4,401,727 A 8/1983 Berke et al.
5,074,936 A * 12/1991 Hazelton ..... 148/403

(Continued)

FOREIGN PATENT DOCUMENTS

CA 2037686 8/1997
EP 1466994 10/2004

(Continued)

OTHER PUBLICATIONS

Johnson, W.L. "Metallic Glasses." ASM Handbook. 2002.*

(Continued)

*Primary Examiner* — Brian Walck
(74) *Attorney, Agent, or Firm* — Kenyon & Kenyon LLP

(57) ABSTRACT

An alloy with a high glass forming ability characterized by containing a group of elements A with atomic radii of less than 0.145 nm of a total of 20 to 85 atm %, a group of elements B with atomic radii of 0.145 nm to less than 0.17 nm of a total of 10 to 79.7 atm %, and a group of elements C with atomic radii of 0.17 nm or more of a total of 0.3 to 15 atm %; when the elements with the greatest contents in the group of elements A, group of elements B, and group of elements C are respectively designated as the "element a", "element b", and "element c", by the ratio of the content of the element a in the group of elements A (for example, Zn and/or Al), the ratio of the content of the element b in the group of elements B (for example, Mg), and the ratio of the content of the element c in the group of elements C (for example, Ca) all being 70 atm % or more; and by the liquid forming enthalpy between any two elements selected from the element a, element b, and element c being negative.

6 Claims, 4 Drawing Sheets

(56) References Cited

U.S. PATENT DOCUMENTS

| | | | | |
|---|---|---|---|---|
| 5,320,688 | A | 6/1994 | Masumoto et al. | |
| 5,423,969 | A * | 6/1995 | Masumoto et al. | 204/196.1 |
| 6,623,566 | B1 | 9/2003 | Senkov et al. | |
| 2005/0279427 | A1 * | 12/2005 | Park et al. | 148/403 |

FOREIGN PATENT DOCUMENTS

| | | |
|---|---|---|
| GB | 2236325 | 4/1991 |
| JP | 05-070877 | 3/1993 |
| JP | 2004-149914 | 5/1994 |
| JP | 06-184712 | 7/1994 |
| JP | 7-48658 | 2/1995 |
| JP | 07-113101 | 5/1995 |
| JP | 07-216407 | 8/1995 |
| JP | 2000-100613 | 4/2000 |
| JP | 2002-256401 | 9/2002 |
| JP | 2005-060805 | 3/2005 |
| JP | 2005-126795 | 5/2005 |
| JP | 2006-2252 | 1/2006 |

OTHER PUBLICATIONS

Sanders, Robert E. "Aluminum and Aluminum Alloys." Kirk-Othmer Encyclopedia of Chemical Technology. Nov. 15, 2002.*

International Search Report dated Oct. 16, 2007 issued in corresponding PCT Application No. PCT/JP2007/064617.

Inoue, et al., "*Recent progress in bulk glassy, nanoquasicrystalline and nanocrystalline alloys*," Materials Science and Engineering A 375-377: 16-30 (2004).

Révész, et al., "*Thermal properties of Hf-based metallic glasses*," Materials and Science and Engineering A 375-377: 381-384 (2004).

Zhang, et al., "*Amorphous (Ti, Zr, Hf)-Ni-Cu ternary alloys with a wide supercooled liquid region*," Materials Science and Engineering A: 181/182: 1423-1426 (1994).

Senkov, et al., "*New calcium based bulk metallic glasses*," Mat. Res. Soc. Symp. Proc. 806: 145-150 (2003).

Gögebakan, "*Mechanical properties of AlYNi amorphous alloys*," Journal of Light Metals 2: 271-275 (2002).

Wang, et al., "*Amorphous forming ability and mechanical properties of rapidly solidified Al-Zr-LTM (LTM= Fe, Co, Ni and Cu) alloys*," Materials Letters 52: 47-52 (2002).

Miedema, et al., "*Model prediction for the enthalpy of formation of transition metal alloys*," Calphad 1(4): 341-359 (1997) (Appendix: 353-359).

Ludwig Schultz, "Formation of Amorphous Metals by Mechanical Alloying," Material Science and Engineering 97(1988), pp. 15-23.

Russian Office Action dated Jun. 4, 2010, for Application No. 2009105659/02(007566), with English translation.

Gilman D.,Metal Glasses, Moscow, "Metallurgiya" Publishers 1984, p. 23-24 (Abstract: last page).

ASM Handbook, vol. 13, Corrosion, ASM International USA, 1987, "Corrosion Protection Method, Hot Dip Coatings" pp. 432-445.

ASM Handbook, vol. 13A, Corrosion: Fundamentals, Testing, and Protection, 2003, "Methods of Corrosion Protection, Continuous Hot Dip Coatings", pp. 786-793.

S. L. Rohde, "Physical Vapor Deposition Coating Processes", Sputter deposition, ASM Handbook, vol. 5, Surface Engineering, pp. 573-581.

D.R.P. Singh et al., "Residual stress characterization of AI/SiC nanoscale multilayers using X-ray synchrotron radiation", Thin Solid Film, 519 (2010), pp. 759-765.

J. Paulitch, "Low friction CrN/TiN multilayer coating prepared by a hybrid high power impulse magnetron sputtering/DC magnetron sputterig deposition technique", Thin Solid Film, 518 (2010), pp. 5553-5557.

Teiichi Kimura et al., "Thermal conductivities of yttriastabilized zirconia films measured by a laser-heating AC method", Surface & Coatings Technology, 198 (2005), pp. 129-132.

Chen et al., "Morphology and Kinetics of Interfacial Layer Formation during Continuous Hot-Dip Galvanizing and Galvannealing", Metallurgical and Materials Transactions A, vol. 39A, Sep. 2008, pp. 2129-2142.

ASM Handbook, vol. 2, Properties and selection: Nonferrous alloys and Special-Purpose Materials 1995.

* cited by examiner

ALLOY WITH HIGH GLASS FORMING ABILITY AND ALLOY-PLATED METAL MATERIAL USING SAME

TECHNICAL FIELD

The present invention-relates to an amorphous alloy and alloy-plated metal material, more particularly relates to an alloy with a high glass forming ability and an alloy-plated metal material with a high corrosion resistance or high heat reflectance using the same.

BACKGROUND ART

Research relating to amorphous alloys in recent years have concentrated on searches for obtaining amorphous structures even with small cooling rates, that is, so-called bulk metallic glasses. Up until now, alloy compositions giving bulk metallic glasses have been discovered by numerous systems of components.

In Japan, Tohoku University's Inoue et al. have been engaged in cutting edge research. The fact that since 1988, Mg—La—(Ni,Cu)-based alloys, lanthanide-Al-transition metal-based alloys, Zr—Al-transition metal-based alloys, and Pd—Cu—Ni—P-based alloys giving bulk metallic glasses have been discovered is explained in Akihisa Inoue, Akira Takeuchi, *Material Science and Engineering A*, Vol. 375-377 (2004) p. 16-30.

Outside Japan, the fact that Hf—Cu—Ni—Al-based alloys, Ti—Ni—Cu-based alloys, and Ca—Mg—Ag-based alloys giving bulk metallic glasses have been discovered is explained in A. Revesez, J-L. Uriarte, D. Louzguine, A. Inoue, S. Surinach, M. D. Baro, A. R. Yavari, *Materials Science and Engineering A*, Vol. 375-377 (2004) p. 381-384, Tao Zhang, Akihisa Inoue, and Tsuyoshi Masumoto, *Materials Science and Engineering A*, Vol. 181/182 (1994) p. 1423-1426, and Oleg N. Senkov and J. Mike Scott, *Materials Research Society Symposium Proceedings*, v806, *Amorphous and Nanocrystalline Metals* (2003) p. 145-150. Further, almost all of the bulk metallic glasses currently reported fall under one of these systems of components.

The features common to these alloys are that the element with the highest concentration among the elements forming the alloy has the greatest atomic radius, the element having the next highest concentration has the smallest atomic radius, and the remaining components are made of elements having intermediate atomic radii, that is, the relationship between the atomic radii and concentrations of the component elements.

The relationship between the atomic radii and concentrations of component elements is disclosed in U.S. Pat. No. 6,623,566 as the rule for selection of elements with a high glass forming ability.

That is, the reported amorphous alloys are alloys using the known discovery of using atoms having giant atomic radii (giant atoms) to increase the difference in atomic radii between elements forming the alloys and thereby improve the glass forming ability. Lanthanide atoms, Ca, etc. are typical examples of giant atoms.

Bulk metallic glass-es which do not fit into this relationship of atomic radii and concentrations of the component elements have been discovered in Fe—B—Si—Nb-based alloys, Ni—Cr—P-B-based alloys, (Co,Cr,Ni)-(Mo,Nb)-(B,P)-based alloys, etc.

However, these alloys use metalloid elements such as B, Si, and P. As metalloid-metal alloys, these can be classified as alloys different from metal-metal alloys.

Currently, the alloys utilizing the high glass forming ability of the metalloid elements of B, Si, or P to obtain bulk metallic glasses are limited to alloys based on the iron-group elements of Fe, Co, and Ni.

Further, on the other hand, as exceptions to the rule for selection of elements disclosed in U.S. Pat. No. 6,623,566, Japanese Patent Publication (A) No. 2002-256401 discloses Cu-based amorphous alloys. Cu has a relatively small atomic radius (0.12780 nm) even among the group of metal elements having small atomic radii, has a large difference in atomic radius from other elements, and enables easy design of an alloy with a high glass forming ability.

Therefore, Cu can be said to be an element relatively easily giving a bulk metallic glasses. However, the Cu-based bulk metallic glasses up to now, as described in Japanese Patent Publication (A) No. 2002-256401, are systems of components using Zr, Hf, or other expensive elements. Amorphous systems of components using less expensive component element are desired.

If judged from the combinations of elements of amorphous alloys discovered up to now, the elements particularly difficult to obtain bulk metallic glasses from as base-elements are metal elements which, while belonging to the group of elements with small atomic radii, have relatively large atomic radii among the group of elements with small atomic radii. Al and Zn correspond to such elements.

Regarding Al-based alloys, Al—Y—Ni-based alloys, Al—, Zr— (Fe,Co,Ni)-based alloys, etc. are described as amorphous alloys in M. Gogebakan, *Journal of Light Metals*, Vol. 2 (2002), p. 271-275 and Limin Wang, Liqun Ma, Hisamichi Kimura, Akihisa Inoue, *Materials Letters*, Vol. 52 (2002), p. 47-52.

However, these alloys cannot be said to be high in glass forming ability. Bulk metallic glasses still cannot be obtained. Further, regarding Zn-based alloys, in the past, amorphous alloy have rarely been reported.

The two elements of Al and Zn have the common points that they have large atomic radii in the group of elements of small atomic radii and also have relatively low melting points among metals.

There is a conventional discovery that "in a composition near the eutectic point with a deep drop, the glass forming ability becomes higher". If the melting point of the base element is low, in a composition with a high concentration of the low melting point element, it is difficult to form a deep eutectic point.

In actuality, in compositions with high Al concentrations or Zn concentrations, there are almost no eutectic compositions with deep drops. This is also a reason why it is difficult to improve the glass forming ability in Al-based alloys and Zn-based alloys.

For example, Japanese Patent Publication (A) No. 5-70877 discloses a high strength, high toughness aluminum alloy material and method of production of the same, but C the aluminum alloy disclosed in this Patent Document has a low glass forming ability. Even if using a copper casting mold for high pressure die-casting, an amorphous phase can only be obtained at the surface layer part.

That is, the aluminum alloy disclosed in the above Patent Document cannot be said to be a bulk metallic glass.

Japanese Patent Publication (A) No. 7-113101 discloses a method of producing an extruded material from an Al-based amorphous alloy powder produced by mechanical ironing. In the case of this method, at the time of hot extrusion, the working temperature ends up exceeding the crystallization temperature, so this method cannot be used to produce an Al-based bulk metallic glass.

Japanese Patent Publication (A) No. 7-216407 discloses a method of using the gas atomizer method to fabricate an Al-based alloy powder including an amorphous phase, filling the powder in a mold, then raising the temperature to the crystallization temperature to obtain a fine crystalline plastically worked material.

Even if trying to improve this technique and produce a bulk metallic glass by raising the temperature to the crystallization temperature or less, it is difficult to believe that the powder particles filled in the mold would adhere and bind at a temperature of the crystallization temperature or less.

In this way, up to now, in Al-based alloys, compositions with a high glass forming ability could not be obtained, so Al-based amorphous alloys could only be obtained as powders or surface layer parts of castings.

On the other hand regarding Zn-based amorphous alloys, Japanese Patent Publication (A) No. 2005-126795 discloses a method of fabrication of a Zn-based amorphous coating film by flame spraying.

This method uses a Zn-based alloy containing 2 to 5 mass % of Mg and rapidly cools it by a $10^{5\circ}$ C./sec or more cooling rate to obtain a Zn-based amorphous coating film.

This method is an invention making up for the low level of glass forming ability of an Zn-based alloy by the large cooling rate process called "flame spraying".

The flame spraying method is utilized for the formation of local coating films or the formation of coating films of small objects, but the productivity is poor, so this method of production is not suited for mass production or production of bulk parts.

Japanese Patent Publication (A) No. 2005'-60805 discloses amorphous alloys comprised of Fe-based alloys, Co-based alloys, and Ni-based alloys including, as a selectively added element, Zn in an amount of up to 20 atm %.

Said amorphous alloy is a film-like alloy member including an amorphous phase fabricated by making amorphous alloy particles having a volume fraction of amorphous phase of 50% or more strike a substrate at a high speed. The Zn concentration of the amorphous alloy particles necessary as a material should again be kept down to within 20 atm %.

Further, Japanese Patent Publication (A) No. 2006-2252 discloses as a magnesium-based amorphous alloy an alloy containing Zn up to 30 atm %. Japanese Patent Publication (A) No. 2004-149914 discloses an alloy comprised of a Zr/Hf-based bulk metallic glass etc. including Zn as a selective element in an amount of 5 to 15 atm %.

However, all of these amorphous alloys are low in Zn concentration. There has never been a bulk metallic glass which could be said to be Zn-based.

At the present time, the issue in the fabrication of Al-based bulk metallic glasses and Zn-based amorphous alloys is that the method for designing an alloy composition with a high glass forming ability when using Al and/or Zn as the base has not yet been elucidated.

If an alloy composition with a high glass forming ability can be obtained, a bulk metallic glass can be obtained in an Al-based amorphous alloy from which a bulk metallic glass could not be obtained in the past and further progress can be expected in the utilization of amorphous alloys.

Further, if Zn-based amorphous alloys never obtained before can be obtained, not only use for hot dip plating materials, but also expanded-new applications of amorphous alloys can be expected.

DISCLOSURE OF THE INVENTION

The present invention has as its objects to provide an alloy composition with a high glass forming ability based on a metal element having a small atomic radius—from which it was conventionally considered hard to obtain an amorphous alloy—and to provide an alloy-plated metal material using this alloy composition to form an amorphous plating layer.

The inventors discovered that by classifying elements by atomic radius into three groups of elements, selecting from these groups of elements a combination giving a negative liquid forming enthalpy among the elements, and forming an alloy by a specific composition never before considered, a superior glass forming ability is exhibited.

They discovered that there are combinations of specific elements able to improve the glass forming ability and ranges of composition of the same in systems of components based on, by mass %, metal elements having small atomic radii—from which it had conventionally been considered difficult to obtain amorphous alloy.

The present invention was made based on the above discovery and has as its gist the following:

Note that the inventors adjusted the content of the metal element used as the base by mass %, but the compositions of amorphous alloys are usually expressed by atm %, so the amorphous alloys of the present invention are also expressed by atm %. Therefore, the base metal element expressed by mass % is not necessarily the base even by atm %.

(1) An alloy with a high glass forming ability comprised by selecting at least one element from each of a group of elements A with an atomic radius of less than –0.145 nm, a group of elements B with an atomic radius of 0.145 nm to less than 0.17 nm, and a group of elements C with an atomic radius of 0.17 nm or more, said alloy characterized in that a total content of elements belonging to the group of elements A is 20 to 85 atm %, a total content of elements belonging to the group of elements B is 10 to 79.7 atm %, and a total content of elements belonging to the group of elements C is 0.3 to 15 atm %, when designating the elements with the greatest contents in the group of elements A, group of elements B, and group of elements C as respectively the "element a", "element b", and "element c", the ratio of the element a in the group of elements A is 70 atm % or more, the ratio of the element b in the group of elements B is 70 atm % or more, and the ratio of the element c in the group of elements C is 70 atm % or more, and a liquid forming enthalpy between any two elements selected from the element a, element b, and element c is negative.

(2) An alloy with a high glass forming ability as set forth in (1), characterized in that said element a is Zn.

(3) An alloy with a high glass forming ability as set forth in (1), characterized in that said element a is Zn or Al, said element b is Mg, and said element c is Ca.

(4) An alloy with a high glass forming ability as set forth in (3), characterized by containing said Zn or Al (element a) in an amount of over 30 to 85 atm %, Mg (element b) in 10 to less than 69.7 atm %, and Ca (element c) in 0.3 to 15 atm %.

(5) An alloy with a high glass forming ability as (set forth in (3), characterized by containing said Zn or Al (element a) in an amount of 40 to less than 64.7 atm %, Mg (element b) in over 35 to 59.7 atm %, and Ca (element c) in 0.3 to 15 atm %.

(6) An alloy with a high glass forming ability as set forth in (3), characterized by containing said Zn or Al (element a) in an amount of 40 to 85 atm %, Mg (element b) in 10 to 55 atm %, and Ca (element c) in 2 to 15 atm %.

(7) An alloy with a high glass forming ability as set forth in (3), characterized by containing said Zn or Al (element a) in an amount of 40 to 70 atm %, Mg (element b) in 20 to 55 atm %, and Ca (element c) in 2 to 15 atm %.

(8) An alloy with a high glass forming ability as set forth in (3), characterized by containing said Zn or Al (element a) in an amount of 40 to less than 63 atm %, Mg (element-b) in over 35 to 55 atm %, and Ca (element c) in 2 to 15 atm %.

(9) An alloy with a high glass forming ability as set forth in any one of (1) to (8), characterized in that said element a is Zn and an element a' with a next greatest content after Zn (element a) is Al.

(10) An alloy with a high glass forming ability as set forth in (9), characterized by containing said Zn (element a) and Al (element a') in a total of 20 to 30 atm %, Mg (element b) in 67.5 to 79.7 atm %, and Ca (element c) in 0.3 to 2.5 atm %.

(11) An alloy with a high glass forming ability as set forth in any one of (1) to (10), characterized by further containing, as elements in said group of elements A, one or more elements selected from Au, Ag, Cu, and Ni in a total of 0.1 to 7 atm %.

(12) An alloy with a high glass forming ability as set forth in any one of (1) to (11), characterized in that said alloy is a plating use alloy.

(13) An alloy-plated metal material having at least at part of its surface an alloy with a high glass forming ability as set forth in (12) as a plating layer, said alloy-plated metal material characterized in that in said plating layer, a volume fraction of 5% or more is an amorphous phase.

(14) An alloy-plated metal material having at least at part of its surface an alloy with a high glass forming ability as set forth in (12) as a plating layer, said alloy-plated-metal material characterized in that in said plating layer, a volume fraction of 50% or more is an amorphous phase.

(15) An alloy-plated metal material having at least at part of its surface an alloy with a high glass forming ability as set forth in (12) as a plating layer, said alloy-plated metal material characterized in that the surface layer of said plating layer is comprised of a single phase of an amorphous phase.

By fabricating an alloy by the composition of the present invention (invention alloy), it is possible to obtain a bulk metallic glass or amorphous alloy in an alloy system from which a bulk amorphous or amorphous structure could not be obtained in the past.

Up to now, even if an amorphous structure could be obtained with an alloy with a low glass forming ability, it was limited to a powder, thin strip, or other such shape. A bulk metallic glass could not be fabricated. According to the present invention, an alloy with high glass forming ability can be obtained.

For example, it becomes possible to produce a bulk metallic glass by high pressure die-casting using a metal casting mold having a high productivity and enabling production of a bulk shape alloy.

Further, according to the present invention, it becomes possible to produce an amorphous alloy even in a system of components from which obtaining an amorphous structure was considered difficult in the past.

BEST MODE FOR CARRYING OUT THE INVENTION

Figure 1:
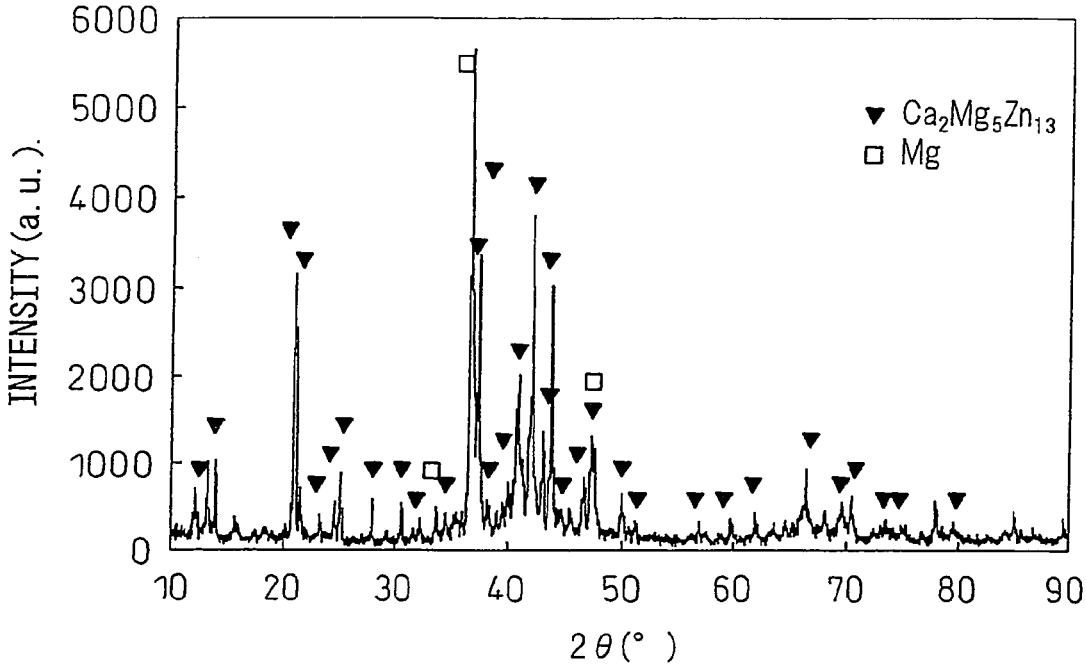
FIG. 1 is an X-ray diffraction chart for a furnace cooled Zn-45 atm % Mg-5 atm % Ca alloy.

The inventors, with the object of obtaining an amorphous alloy based on, by mass %, a metal element having a small atomic radius, reevaluated the conventional findings for discovering alloy compositions with large amorphous forming abilities and searched through various combinations of metal elements.

As a result, the inventors independently derived a selection of component elements and rule by which the compositions are related for alloy compositions exhibiting a high glass forming ability.

When discussing the glass forming ability, the general practice is to use the atomic radii of the component elements and the liquid forming enthalpy of the combinations of the elements.

In the present invention, for the atomic radii, the values described in U.S. Pat. No. 6,623,566 were used, while for the liquid forming enthalpies, the values described in *CALPHAD*, Vol. 1, No. 4, pp. 341-359 (1977), (Pergamon Press (Appendix: pp. 353-359) were used. For lanthanide elements not described in the Appendix (Ce to Lu), the values of La, Y, and Sc described in the Appendix (pp. 358) were used.

The liquid forming enthalpy shows the energy of the system when forming a liquid, so a negative sign and large absolute value means a low energy of the system when forming a liquid and a stable liquid state. That is, when an alloy has a liquid forming enthalpy which is negative and large in absolute value, it means that even if the temperature falls, the liquid state will be stable.

An amorphous is a structure obtained by freezing the atomic structure of a liquid. An alloy with a liquid forming enthalpy which is negative and large in absolute value has a stable liquid state down to a low temperature, so is an alloy with a high glass forming ability.

In this way, the liquid forming enthalpy is convenient for estimating the glass forming ability, but experimental data on the liquid forming enthalpy is limited. There is also the defect that each measurer differs in measurement method, measurement temperature, and evaluation of error.

On the other hand the liquid forming enthalpy was theoretically calculated by the Miedema group for most of the combinations of binary alloys of the Periodic Table (*CALPHAD*, Vol. 1, No. 4, pp. 341-359 (see 1977), Pergamon Press). If using these calculated values as a database, it is possible to obtain liquid forming enthalpies evaluated by the same precision for a large number of alloy systems. Therefore, the present invention also uses these values.

Below, the rule unique to the present invention and the features of the alloys with high glass forming ability prepared in accordance with this rule will be explained in detail.

Note that the glass forming ability of the individual alloy compositions is sometimes discussed, but the alloy glass forming ability can be easily confirmed using a differential scanning calorimeter (DSC).

To confirm the alloy glass forming ability, the single roll method etc. may be used to fabricate an actual amorphous alloy and the $T_g/T_m$ ratio ($T_g$: alloy glass transition temperature (K) of the alloy, $T_m$: melting point (K) of the alloy) may be measured.

The larger the $T_g/T_m$ ratio (absolute temperature ratio), the higher the glass forming ability. If the $T_g/T_m$ ratio is 0.56 or more, high pressure die-casting using a copper casting mold may be used to fabricate a bulk metallic glass.

When obtaining an amorphous alloy, utilizing the difference in atomic radii of the component elements to increase the strain energy in the alloy and make it hard for the atoms to move in the liquid is effective for increasing the glass forming ability. For this reason, mixing three or more types of elements with large differences in atomic radii is a common practice. The present invention is also based on this common practice.

The elements are differentiated into the group of elements A with atomic radii of less than 0.145 nm (small atomic radius), the group of elements A with atomic radii of 0.145 nm to less than 0.17 nm (medium atomic radius), and the group of elements C with atomic radii of 0.17 nm or more (large atomic radius).

In the present invention, the object is to find a method for designing an alloy composition with a high glass forming ability based on an atom with a low glass forming ability and with a small atomic radius.

As the atom with the small atomic radius desired to be used as the base, first elements having an atomic radius of less than 0.145 nm are set as elements with a small atomic radius in the present invention. The group of elements with small atomic radii is made the "group of elements A".

The group of elements A include, in addition to Be, the Group V to Group XI elements of the Periods IV, V, and VI, Al, Zn, Ga, or other metal elements, B, C, Si, P, and the Group IV to Group XVI elements of the Period IV.

The inventors studied alloy compositions based on elements of the group of elements A and having high glass forming ability and as a result found that by making the boundary value of the atomic radii between the group of elements B with the medium atomic radii and the group of elements C with the large atomic radii 0.17 nm and combining with the elements of the group of elements A the elements of the group of elements B and elements of the group of elements C, an alloy composition with a high glass forming ability can be obtained.

For this reason, the boundary value for differentiating the group of elements B and the group of elements C in atomic radius was made 0.17 nm.

Note that as disclosed in U.S. Pat. No. 6,623,566, from In (0.1659 nm) to Yb (0.17 nm), the atomic radius changes greater compared with between other elements. From this point as well, the inventors judged that differentiating the groups of elements at 0.17 nm would be suitable.

Due to this classification, the group of elements B include Li, Mg, Sc, the Group IV elements, Pr, Nd, Pm, and Tm in the lanthanide elements, the Group XII to Group XVI elements of the Period V, Bi, and Po.

The group of elements C include Na, K, Rb, Cs, Ca, Sr, Ba, Y, La, Ce, or other lanthanide elements not included in the group of elements B, Tl, and Pb.

The elements belonging to the group of elements A are defined as the "Group A elements" and similarly the elements belonging to the group of elements' B and group of elements C are defined as the "Group B elements" and "Group C elements". In the alloy of the present invention, one or more elements are selected from each of the Group A elements, Group B elements, and Group C elements to form the alloy.

The conventional rule in selection of elements is to design the composition of components using as the base the group of elements having the largest atomic radii in the component elements. As opposed to this, the rule in selection of elements in the present invention is characterized in that it is possible to design a composition of components based on, by mass %, the group of elements having the smallest atomic radii so as to realize a bulk metallic glass.

As explained above, the inventors adjusted the content of the metal elements forming the base by mass %, but the composition of an amorphous alloy is usually expressed by the atm % used. Below, the composition of the amorphous alloy will be explained by atm %.

The basic composition of the amorphous alloy of the present invention (invention alloy), to stably secure the glass forming ability, is made a total content of the Group A elements of 20 to 85 atm %, a total content of the Group B elements of 10 to 79.7 atm %, and a total content of the Group C elements of 0.3 to 15 atm %.

The Group A elements are the metal elements forming the base (mass %). By atm %, 20 atm % or more is required. However, if over 85 atm %, the alloy glass forming ability remarkably falls, so the upper limit was made 85 atm %.

The content (total) of the Group B elements and the content (total) of the Group C elements, to secure the required glass forming ability, are made 10 to 79.7 atm % and 0.3 to 15 atm % in relation with the content (total) of the Group A elements.

That is, if any of the content of the Group A elements, the content of the Group B elements, and the content of the Group C elements becomes outside the above range of composition, the balance of content among the groups of elements is lost and the glass forming ability falls.

Further, designating the elements with the greatest content in the Group A elements, Group B elements, and Group C elements (main elements) as the "element a", "element b", and "element c", the ratio of the content of the element a with respect to the total content of the Group A elements, the ratio of the content of the element b with respect to the total content of the Group B elements, and the ratio of the content of the element c with respect to the total content of the Group C elements are all made 70 atm % or more.

If the ratio of content of the element a, element b, and/or element c becomes less than 70 atm % in the group of elements, the effect of the elements other than the main elements in the group of elements on the glass forming ability can no longer be ignored.

For example, if the ratio of content of elements other than the main elements in the group of elements becomes 30 atm % or more, precipitation of the individual metal components or precipitation of new intermetallic compounds easily occurs. If this precipitation occurs, the alloy glass forming ability falls.

In terms of securing a stable glass forming ability, the ratios of contents of the element a, element b, and element c in the respective groups of elements are preferably 85 atm % or more, more preferably 90 atm % or more.

Further, in all combinations of two elements selected from element a, element b, and element c, the liquid forming enthalpy must be negative. If even one combination of the element a, element b, and element c of all of the combinations of elements is a combination with a positive liquid forming enthalpy, the glass forming ability falls.

In the present invention, by selecting Zn or Al as the element a and selecting the element b and element c from the above-mentioned group of elements B and group of elements C, it is possible to obtain an amorphous alloy.

Selecting Mg and Ca as the element b and element c is preferable in terms of improving the corrosion resistance of the alloy while maintaining the glass forming ability, but the contents of Mg and Ca differ somewhat, depending on the content of the Zn or Al (element a), in the ranges of 10 to 79.7 atm % and in the range of 0.3 to 15 atm %.

Note that, even when the element a is the base by mass %, the Mg content sometimes exceeds the content of the element a by atm %.

Zn or Al (element a) is preferably included in an amount of over 30 atm % so as to secure a stable glass forming ability. If Zn or Al (element a) is over 30 to 85 atm %, Mg (element b) is preferably less than 10 to 69.7 atm % and Ca (element c) is preferably 0.3 to 15 atm %.

Zn or Al (element a) is more preferably 40 to less than 64.7 atm %, but in this case, Mg (element b) is made over 35 to 59.7 atm % and Ca (element c) is made 0.3 to 15 atm %.

Ca has a relatively large effect on the glass forming ability, so Ca (element c) is preferably made 2 to 15 atm %.

When making Ca (element c) 2 to 15 atm %, Zn or Al (element a) is preferably 40 to 85 atm % and Mg (element b) is preferably 10 to 55 atm %.

When making Ca (element c) 2 to 15 atm %, Zn or Al (element a) is more preferably 40 to 70 atm %, but in this case, Mg (element b) is preferably 20 to 55 atm %.

When making Ca (element c) 2 to 15 atm %, Zn or Al (element a) is more preferably 40 to less than 63 atm %. In this case, Mg (element b) is over 35 to 55 atm %.

Even when selecting Zn as the element a and selecting Al as the element a' of the next greatest content after Zn (element a), a superior glass forming ability can be secured.

Zn and Al are relatively close in melting point and atomic radius, so in the invention alloy, Zn and Al can be handled together.

Further, Zn and Al, in the equilibrium diagram, do not form an intermetallic compound with a high melting point comprised of the two elements of Zn and Al at all, so no rise in the melting point is caused and no dross-like substance covering the molten metal surface is formed at the time of melting the alloy.

Further, in the case of an alloy with Zn as its base, addition of a small amount of Al lowers the melting point of the alloy itself. Unless instantaneously cooling the alloy down to the glass transition temperature, in an alloy designed for formation of an amorphous phase, a drop in the alloy melting point is preferable for increasing the glass forming ability.

However, as can be deduced from the Al—Zn equilibrium diagram, there is an optimum value to the amount of addition of Al. The ratio of Zn in the total of Zn and Al is preferably 70% or more, more preferably 80% or more.

In this case, it is preferable to make Zn (element a) and Al (element a') a total of over 30 to 85 atm %, to make Mg 10 to less than 69.7 atm %, and to make Ca 0.3 to 15 atm %.

The total of Zn (element a) and Al (element a') is more preferably 40 to less than 64.7 atm %, but in this case, Mg is made over 35 to 59.7 atm % and Ca is made 0.3 to 15 atm %.

Ca has a relatively large glass forming ability, so Ca (element c) is preferably made 2 to 15 atm %.

When making Ca (element c) 2 to 15 atm %, the total of Zn (element a) and Al (element a') is preferably 40 to 85 atm % and Mg (element b) is preferably 10 to 55 atm %.

When making Ca (element c) 2 to 15-atm %, the total of Zn (element a) and Al (element a') is more preferably 40 to 70 atm %. In this case, Mg (element b) is preferably 20 to 55 atm %.

When making Ca (element c) 2 to 15 atm %, the total (of Zn (element a) and Al (element a') is more preferably 40 to less than 63 atm %. In this case, Mg (element b) is over 35 to 55 atm %.

Further, preferably the total of Zn (element a) and Al (element a') is made 20 to 30 atm %, Mg is made 67.5 to 79.7 atm %, and Ca is made 0.3 to 2.5 atm %.

The reason for defining the concentration of Ca low in the above range of composition will be explained later.

The reason why the glass forming ability rises in the range of composition of the present invention is not necessarily clear, but the inventors discovered that in the range of composition of the present invention, a stable three-way intermetallic compound comprised of the element a, element b, and element c is easily formed.

The fact that when a stable intermetallic compound is formed between elements forming the alloy and the change in enthalpy due to the formation of the intermetallic compound is large, the glass forming ability becomes higher is known empirically.

Therefore, it is fully conceivable that formation of a three-way intermetallic compound would play some role in improvement of the glass forming ability.

In a composition with a low glass forming ability outside the range of composition of the present invention, binary intermetallic compounds comprised of combinations of two types of elements from the element a, element b, and element c are preferentially formed.

Therefore, the inventors considered that there is a good chance that a composition preferentially forming a three-way intermetallic compound would improve the glass forming ability.

Further, the inventors guessed that even with binary intermetallic compounds, intermetallic compounds comprised of extremely large numbers of atoms and having complicated crystalline structures, for example, $Mg_{51}Zn_{20}$, $Mg_{17}Al_{12}$, etc. contribute to a certain degree to the improvement of the glass forming ability.

Among these groups of elements, if in the range of less than 30 atm % of the total of the contents of the groups of elements, it is also possible to add an element different from the element a, element b, and element c. The added element becomes an obstacle hindering movement of the atoms in the molten alloy at the time of melting the alloy, exhibits an effect increasing the strain energy in the alloy at the time of solidification, and improves the glass forming ability somewhat.

In the conventional understanding, even among the Group A elements, Al and Zn make design of an alloy composition with a high glass forming ability difficult and make an Al- or Zn-based bulk metallic glass or amorphous alloy difficult to obtain.

However, if designing the alloy composition selecting Al or Zn as the element a along with the rule of the present invention, it is possible to form a bulk metallic glass or amorphous structure even with an alloy with a high Al or Zn concentration. This was found by research of the inventors.

However, when applying the rule of the present invention to an Al—Mg—(Ca,La,Y) system, care is required. In the case of an alloy comprised by selecting Al as the element a, Mg as the element b, and Ca, La, or Y as the element c, severe bubbling occurs near a melting temperature of 500 to 800° C.

In particular, when La or Y is included, bubbling is severe and the viscosity is high, so the work of melting and solidifying the alloy becomes difficult.

The cause of this bubbling is not elucidated, but it is believed that this is related to the fact that the melting temperature of Al is near the ignition points of Mg or Ca, La, and Y.

If melting, then slowly cooling an Al—Mg—(Ca,La,Y)-based alloy, the time for the alloy to pass through 500 to 800° C. becomes long and the amount of bubbling increases. This alloy becomes semimolten in state at 500 to 800° C. and is high in viscosity, and the gas formed is not released to the outside, so the volume increases and the result becomes a closed pore foam material.

This alloy becomes uneven in heat conductivity due to the pores formed. Even if the glass forming ability is high, it is believed that the volume fraction of the amorphous phase is small.

Therefore, when using these alloys for the fabrication of an amorphous alloy, a large cooling rate becomes necessary for suppressing the formation of pores. For example, to suppress bubbling, the alloy is cooled to a ribbon shape.

If the thickness becomes 50 μm or less, the cooling rate is sufficiently obtained and an amorphous thin strip is easily obtained. Further, it is possible to form a thin film to suppress the bubbling, so use as a plating is suitable as the application of this alloy.

In addition, if using high pressure die-casting, it becomes possible to fabricate a bulk amorphous structure with no pores up to a thickness of about 1 mm.

Zn has no possibility of bubbling. This is believed to be due to the fact that Zn has a melting point of a low 410° C. and a low viscosity at 500 to 800° C. Further, Zn is believed to be effective for raising the ignition temperature of Mg or Ca. For this reason, in the alloy of the present invention, there is no possibility of ignition until the melting temperature.

An amorphous alloy of the present invention in which Al or Zn is selected as the element a, Mg is selected as the element b, and Ca is selected as the element c can sufficiently secure an glass forming ability even without using Y, La, or another expensive rare earth element. For this reason, the amorphous alloy of the present invention is preferable economically and industrially.

In a Zn-based alloy, by the addition of Mg or Ca, it is possible to improve the glass forming ability while raising the corrosion resistance, so addition of Mg and/or Ca is suitable from this point as well.

In an Al—Mg—Ca-based alloy and Zn—Mg—Ca-based alloy of the present invention, by making the content of Al or Zn over 30 to 85 atm %, making the content of Mg 10 to less than 69.7 atm %, and making the content of Ca 0.3 to 15 atm %, it becomes possible to obtain a much higher glass forming ability.

In the case of an Zn—Mg—Ca system, in the equilibrium state of the above range of composition, $Ca_2Mg_5Zn_{13}$ (three-way intermetallic compound) is formed in an 80% or more volume fraction and the glass forming ability becomes extremely high.

However, in a composition outside of the above range of composition, $MgZn_2$ or another binary intermetallic compound or an Mg or Zn solid metal phase is formed in a 20% or more volume fraction and the glass forming ability becomes somewhat low.

In a range of composition where the total of Zn (element a) and Al (element a') is 20 to 30 atm %, Mg is 67.5 to 79.7 atm %, and Ca is 0.3 to 2.5 atm %, if the cooling rate is relatively large, $Mg_{51}Zn_{20}$ is formed.

Note that cooling rate being relatively large means not the quenching method such as with the single roll method, but for example a cooling rate of an extent of immersion of a small amount of a molten metal in water for rapid cooling.

In particular, near an Zn of 28 atm % and Mg of 72 atm %, this intermetallic compound is easily formed.

When the Ca concentration is low, this intermetallic compound is easily formed, but when the Ca concentration is high, the blending ratio becomes unbalanced and formation becomes difficult, so the upper limit of the Ca concentration is made 2.5 atm %.

The inventors believed that when the Ca concentration is low, Ca atoms are filled in the cavities formed by the regular regular icosahedral structures and, as a result, binary intermetallic compounds probably perform the same role as three-way intermetallic compounds.

When fabricating an amorphous alloy by the quenching solidification method, the melting point and viscosity of the alloy are preferably low. The melting point and viscosity are correlated. If comparing the viscosities of molten alloys held at the same melting temperature, in general ones with low melting points have low viscosities.

In the case of a high viscosity, when using the single roll method to fabricate an amorphous thin strip, nozzle clogging is caused. Even with high pressure die-casting, insufficient filling or other defects are caused.

In the case of a Zn—Mg—Ca system, preferably the composition of the alloy of the present invention is further limited by (a) making Zn (element a) over 30 to 85 atm %, Mg (element b) 10 to less than 69.7 atm %, and Ca (element c) 0.3 to 15 atm %, by (b) making Zn (element a) 40 to less than 64.7 atm %, Mg (element b) over 35 to 59.7 atm %, and Ca (element c) 0.3 to 15 atm %, by (c) making Zn (element a) 40 to 85 atm %, Mg (element b) 10 to 55 atm %, and Ca (element c) 2 to 15 atm %, by (d) making Zn (element a) 40 to 70 atm %, Mg (element b) 20 to 55 atm %, and Ca (element c) 2 to 15 atm %, or by (e) making Zn (element a) 40 to less than 63 atm %, Mg (element b) over 35 to 55 atm %, and Ca (element c) 2 to 15 atm %.

Due to this limitation, it becomes possible to fabricate an alloy having a low melting point, a low viscosity even at a melting temperature near 550° C., and having a composition advantageous to the production of an amorphous structure.

Further, an Zn—Mg—Ca-based alloy in the above range of composition has a relatively high glass forming ability and enables an amorphous phase to be easily obtained.

Further, an alloy in said range of composition has a melting-point near 520° C. or below it, which is lower than ignition point of Mg (the ignition point of Mg in this composition being around 570° C. due to the inclusion of Zn and Ca), so can be melted without concern about the ignition point. It is therefore advantageous in this point.

In the above range of composition, in the equilibrium state, in addition to $Ca_2Mg_5Zn_{13}$, $Zn_3Mg_7$ and Mg are formed. The inventors believe that the fact that these products form eutectic crystals is a factor for maintaining the melting point low and raising the glass forming ability.

In the case of an Al—Mg—Ca system, like with a Zn—Mg—Ca system, preferably the composition of the alloy of the present invention is further limited by (a) making Al (element a) over 30 to 85 atm %, Mg (element b) 10 to less than 69.7 atm %, and Ca (element c) 0.3 to 15 atm %, by (b) making Al (element a) 40 to less than 64.7 atm %, Mg (element b) over 35 to 59.7 atm %, and Ca (element c) 0.3 to 15 atm %, by (c) making Al (element a) 40 to 85 atm %, Mg (element b) 10 to 55 atm %, and Ca (element c) 2 to 15 atm %, by (d) making Al (element a) 40 to 70 atm %, Mg (element b) 20 to 55 atm %, and Ca (element c) 2 to 15 atm %, or by (e)

making Al (element a) 40 to less than 63 atm %, Mg (element b) over 35 to 55 atm %, and Ca (element c) 2 to 15 atm %.

Due to this limitation, it becomes possible to fabricate an alloy having a low melting point, a low viscosity even at a melting temperature near 600° C., and having a composition advantageous to the production of an amorphous structure.

At the above low melting point, formation of $Mg_{17}Al_{12}$ comprised of Mg and Al (melting point: 460° C.) is believed to greatly contribute to this.

In an Al—Mg—Ca system, the bubbling becomes a problem, but if an alloy in the above range of composition, it is possible to shorten the time for passing the bubbling temperature region at the time of solidification, so it is possible to relatively easily cast an amorphous alloy while suppressing bubbling. This is advantageous in fabricating an amorphous alloy.

In a (Zn+Al)—Mg—Ca system (however, amount of Zn>amount of Al) as well, as explained above, the composition of the alloy of the present invention is limited by (a) making Zn (element a)+Al (element a') over 30 to 85 atm %, Mg (element b) 10 to less than 69.7 atm %, and Ca (element c) 0.3 to 15 atm %, by (b) making Zn (element a)+Al (element a') 40 to less than 64.7 atm %, Mg (element b) over 35 to 59.7 atm %, and Ca (element c) 0.3 to 15 atm %, by (c) making Al (element a) 40 to 85 atm %, Mg (element b) 10 to 55 atm %, and Ca (element c) 2 to 15 atm %, by (d) making Al (element a) 40 to 70 atm %, Mg (element b) 20 to 55 atm %, and Ca (element c) 2 to 15 atm %, or by (e) making Al (element a) 40 to less than 63 atm %, Mg (element b) over 35 to 55 atm %, and Ca (element c) 2 to 15 atm %.

Further, on the other hand, in a (Zn+Al)—Mg—Ca system (where amount of Zn>amount of Al), the composition of the alloy of the present invention is limited by (f) making Zn (element a)+Al (element a') 20 to 30 atm %, Mg (element b) 67.5 to 79.7 atm %, and Ca (element c) 0.3 to 2.5 atm %.

By these limitations, it becomes possible to fabricate an alloy having a low melting point, having a low viscosity even at a melting temperature near 550° C., and having a composition advantageous for production of an amorphous structure.

Further, in the Al—Mg—Ca-based alloy, Zn—Mg—Ca-based alloy, and (Zn+Al)—Mg—Ca-based alloy of the present invention, if including as part of the Group A elements at least one of Au, Ag, Cu, and Ni in an amount of 0.1 to 7 atm %, the glass forming ability is improved.

With a content of less than 0.1 atm % with respect to the composition as a whole, there is no effect of improvement of the glass forming ability. When the content is 3 to 4 atm %, the glass forming ability is improved the most.

However, if the content exceeds 7 atm %, individual metal components precipitate or binary intermetallic compounds including additive atoms preferentially precipitate and the glass forming ability becomes extremely low.

The alloy of the present invention is an alloy with a high glass forming ability, so it is possible to use the liquid quenching method to easily fabricate an amorphous alloy.

Therefore, in the present invention, among the production methods for raising the temperature of the alloy to the melting point or more to achieve the molten state once, then finally producing a solid product (casting methods in the broad sense), the single roll method and high pressure die-casting or the casting method using a copper casting mold are defined as liquid quenching methods.

The liquid quenching methods in the broad sense include almost all casting methods, but among these, the single roll method and high-pressure die casting are production methods enabling mass production of bulk products.

However, these methods of production are slower in cooling rate compared with the atomizer method or piston anvil method etc., so are methods of production requiring a relatively high glass forming ability.

The alloy of the present invention at least enables the production of amorphous thin strip by the single roll method. From the past, with an alloy enabling the production of an amorphous thin strip by the single roll method, it has been possible to produce a bulk metallic glass by high pressure die-casting using a copper casting mold.

As one embodiment of the present invention, there is an amorphous alloy-plated metal material containing an amorphous phase. As an alloy-plated metal material, a Zn-based or Al-based alloy plated steel material is being widely used in the automobile, home electric appliance, building material, civil engineering, and other fields, but up until now it was difficult to obtain an alloy of a composition improving the glass forming ability in Zn-based alloys or Al-based alloys. Therefore, in alloy plating, there was never any plating having an amorphous phase.

According to the present invention, in Zn-based alloys and Al-based alloys, it is possible to obtain an alloy of a composition with a high glass forming ability, so it is possible to produce a Zn-based and Al-based alloy-plated metal material including an amorphous phase.

As the method for fabrication of an amorphous alloy-plated metal material, there are the electroplating method, flame spraying method, vapor deposition method, hot dip plating, etc. However, the invention alloy uses at the minimum three types of elements, so if considering the preferential precipitation of elements etc., it is difficult to maintain the bath conditions for obtaining a predetermined composition constant at all times in the electroplating method. Therefore, the electroplating method is a plating method with problems in stability of production.

The flame spraying method and vapor deposition method are inherently methods enabling high cooling rates, but continuous operation is costly, so these methods are not suitable for mass production.

In the flame spraying method or vapor deposition method, if increasing the temperature of the substrate so as to improve the adhesion of the plating layer, the cooling rate becomes relatively smaller. However, if using an invention alloy with a high glass forming ability, it is possible to easily form an amorphous phase without being restricted by the film-forming conditions.

As opposed to these methods, hot dip plating is a method for which a large cooling rate is difficult to obtain, but the productivity is extremely high, so it is an optimal method for obtaining an amorphous alloy-plated metal material using an alloy enabling a high glass forming ability according to the present invention.

Further, the alloy of the present invention has a melting point of 350 to 800° C., so hot dip plating can be preferably used.

If using hot dip plating to fabricate the amorphous alloy-plated metal material of the present invention, the Sendzimir method, flux method, preplating method, or all other hot dip plating may be used.

Among the alloys of the present invention as well, when plating an alloy having a somewhat low glass forming ability, to obtain a greater amount, by volume fraction, preferably 50% or more, of an amorphous phase, the plating thickness has to be reduced.

With the usual cooling method, the closer to the surface, the higher the cooling rate, so if making the plating thickness thinner, the amorphous phase volume fraction increases.

When plating an alloy having a somewhat low glass forming ability, right after the plating, −150° C. low temperature nitrogen gas right after evaporation of liquid nitrogen is used to cool the plating layer.

Further, the plating layer can be directly dipped into liquid nitrogen to further speed the cooling rate for cooling.

The metal of the substrate of the plated metal material of the alloy of the present invention is not particularly limited to any specific metal, but when using hot dip plating to plate an invention alloy, a metal with a higher melting point than the melting point of the plating alloy is necessary.

When using a metal forming an oxide film on the surface which is extremely stable and poor in reactivity with the plating metal as the substrate (for example, an Al—Mg—Ca-based substrate), the preplating method etc. has to be applied in some cases.

When selecting a steel material as the substrate of the alloy-plated metal material of the present invention, the grade of the steel material is not particularly limited. Al-killed steel, ultralow carbon steel, high carbon steel, various high strength steels, Ni,Cr-containing steels, etc. may be used.

The steelmaking method, hot rolling method, pickling method, cold rolling method, or other pretreatment of the steel material is not particularly limited.

From the viewpoints of the ease of hot dip plating, cost performance as a material, etc., a steel material is most preferred as the substrate of the present invention.

When selecting a copper material as the substrate of the alloy-plated metal material of the present invention, since the copper material and the Al-based alloy are close in melting points, it is unsuitable to select an Al-based alloy as a plating metal.

When plating a Zn-based alloy on a copper material, an intermetallic compound phase is easily formed with the copper material, so the dipping time in the plating bath is preferably made 3 seconds or less.

The volume of the amorphous phase in the plating layer can be measured by cutting the plated metal material at a plane vertical to the surface, polishing and etching the cross-section, and observing the cross-section of the plating layer by an optical microscope.

In the amorphous phase parts, no structure is observed even with etching, while in the crystal phase parts, structures due to crystal grain boundaries, sub-boundaries, and deposits, etc. are observed.

Due to this, it is possible to clearly differentiate between the amorphous phase parts and crystal phase parts, so it is possible to convert to the volume fraction by the line segment method or image analysis.

When the structure is too fine and measurement by an optical microscope is difficult, a thin section is prepared from the cross-section of the plating layer and observed by a transmission electron microscope and similarly measured.

In the case of a transmission electron microscope, it is possible to confirm an amorphous structure from the halo pattern of the electron beam diffraction image in the region where the structure is not observed.

In observation by an optical microscope, when the structure is not observed at the entire surface or even when there are parts where the structure is not observed and there is a suspicion of coarse, strain-free crystal grains, it is preferable to obtain thin sections for electron microscope use and confirm that the electron beam diffraction image has no diffraction spots and exhibits a halo pattern and confirm that the structure is an amorphous phase.

For the volume fraction, for both an optical microscope or an electron microscope, it is preferable to observe 10 or more different fields, find the area ratios by image processing by computer, and obtain the average to convert to the volume fraction.

The alloy plating layers in the range of composition of the present invention all exhibit corrosion resistances of hot dip galvanized steel plate or more.

If the composition of components is the same, an amorphous alloy plating is better in corrosion resistance compared with a crystalline alloy plating. By including an amorphous phase in a volume fraction of the plating layer of 5% or more, the plating is improved in the corrosion resistance.

This effect of improvement of the corrosion resistance can be confirmed by a cyclic corrosion test, electrochemical measurement, etc. For example, the inventors evaluated the corrosion resistance of the actual environment by a cyclic corrosion test (JASO M 609-91, 8 hr/cycle, wet/dry time ratio 50%, however, using 0.5% saltwater as the saltwater) and as a result that plated steel plate containing 5% or more of an amorphous phase has less corrosion loss than crystalline alloy plating of the same composition of components.

Further, in electrochemical measurement (in 0.5% NaCl solution, vs Ag/AgCl), having an amorphous phase in the plating layer results in a noble corrosion potential compared with an alloy plating of the same composition but only a crystal phase. Further, the corrosion current density near the corrosion potential became small.

The effect of the amorphous phase on the corrosion resistance appears remarkably when the amorphous phase is present in a volume fraction of 50% or more.

This is believed to be due to the facts that there are no crystal grain boundaries forming starting points of corrosion and also Mg, Ca, or other components improving the corrosion resistance are uniformly distributed over the plating layer.

In crystalline plating, intermetallic compounds of different compositions, single metal phases, alloy phases, etc. are formed in the plating layer, so these form coupling cells, whereby corrosion is promoted.

However, in an amorphous alloy plating, originally there is no intermetallic compound or other crystal phase and the component elements uniformly distribute over the plating layer, so such promotion of corrosion does not occur.

The effect of improvement of the corrosion resistance by the amorphous phase is generally remarkably observed in a Zn-based alloy. With Zn, the solid solution limit of Mg, Ca, or other additive elements improving the corrosion resistance is small, so even if added in a small amount, an intermetallic compound ends up being easily formed.

On the other hand, in an Al-based alloy, originally, an Al-based alloy has a higher corrosion resistance compared with a Zn-based alloy. The solute limit of Mg, Ca, etc. is large, so an intermetallic compound is hard to form.

In an amorphous alloy plating, if the surface layer (layer within 2 μm from surface of plating layer) becomes a complete amorphous phase not containing any crystal phase, the corrosion resistance is remarkably improved and, further, the fine projections on the surface due to the crystal phase are eliminated.

As a result, it is possible to obtain a plated metal material with a high reflection surface in which surface projections of a level relating to the reflection of electromagnetic waves smoothed. This high reflectance plated metal material is particularly useful as a heat reflecting material.

To confirm the existence of an amorphous phase of the surface layer, the thin film X-ray diffraction method irradiating X-rays at the plating surface at a low incident angle and measuring the diffracted X-rays by a collimating optical system is suitable.

In the present invention, the "plating" for which diffraction peaks due to a crystal phase cannot be detected using Kα-X-rays of copper under conditions of an incident angle of 1° is defined as the "plating" of a single amorphous phase of the surface layer. The heat reflectance of the metal material having this "plating" becomes a level higher than a crystal phase plated metal material.

Note that "diffraction peaks due to a crystal phase" means diffraction peaks significantly higher in X-ray intensity than the background level and not broad. For example, it indicates a peak having a peak height of a 50% or more of the background intensity and having a half value width of the peak of 1° or less.

EXAMPLES

The present invention will be explained in further detail while showing examples.

Example 1

Zn, Mg, and Ca metal reagents (purity 99.9 mass % or more) were mixed and melted using a high frequency induction heating furnace in an Ar atmosphere at 600° C., then furnace cooled to obtain a Zn: 50 atm %, Mg: 45 atm %, Ca: 5 atm % chemical composition furnace cooled alloy.

This furnace cooled alloy had an X-ray diffraction chart as shown in FIG. 1. With this composition, as an equilibrium phase, the intermetallic compound $Ca_2Mg_5Zn_{13}$ is formed.

The alloy of said composition was used to fabricate a thin strip sample by the single roll method. The thin strip sample was fabricated using a Nisshin Giken single roll apparatus (RQ-1).

A quartz crucible having a slit-shaped aperture (0.6 mm×20 mm) at its bottom end was charged with the alloy to 0.1 kg and heated. The alloy was held at a temperature 100° C. higher than the melting point of 346° C. (619K) for 5 minutes, then the molten alloy was ejected on to a Cu roll (roll diameter 300 mm) rotated at a peripheral speed of 50 m/sec by a pressure of 0.03 MPa.

The distance between the aperture and roll surface at the time of ejection was 0.2 mm. The obtained thin strip sample had a width 3 to 10 mm, a length of 50 to 100 mm, and a thickness of about 10 to 20 μm.

Figure 2:
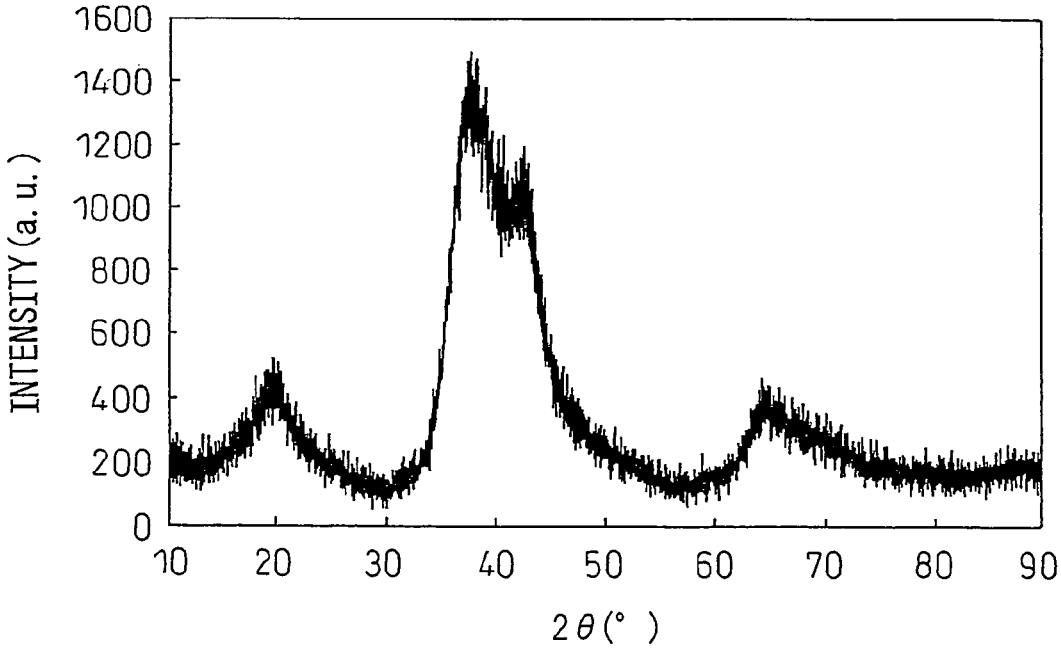
FIG. 2 is an X-ray diffraction chart of a thin strip sample of a Zn-45 atm % Mg-5 atm % Ca alloy obtained by the single roll method.

The prepared thin strip sample had an X-ray diffraction chart by the thin film X-ray diffraction method as shown in FIG. 2. As shown in FIG. 2, the peak of the crystal phase disappeared and a halo pattern distinctive to an amorphous phase was detected.

Example 2

Zn, Al, Mg, and Ca metal reagents (purity 99.9 mass % or more) were mixed and melted using a high frequency induction furnace in an Ar atmosphere at 600° C., then furnace cooled to obtain the a furnace cooled alloy of a chemical composition of Zn:45 atm %, Mg:50 atm %, and Ca:5 atm %.

This alloy was used to fabricate a thin strip sample by the single roll method. For fabrication of the thin strip sample, a single roll apparatus (RQ-1) made by Nisshin Giken was used.

A quartz crucible having a slit-shaped aperture (0.6 mm×20 mm) at its front end was charged with 0.1 kg of the alloy and heated. The alloy was held at a temperature of 100° C. higher than the melting point 373° C. (646K) for 5 minutes. The molten alloy was ejected at a pressure of 0.03 MPa on a Cu roll (roll diameter 300 mm) rotated at a peripheral speed of 50 m/sec.

The distance between the aperture and roll surface at the time of ejection was 0.2 mm. The obtained thin strip sample had a width of 3 to 10 mm, a length of 50 to 100 mm, and a thickness of about 10 to 20 μm.

Figure 3:
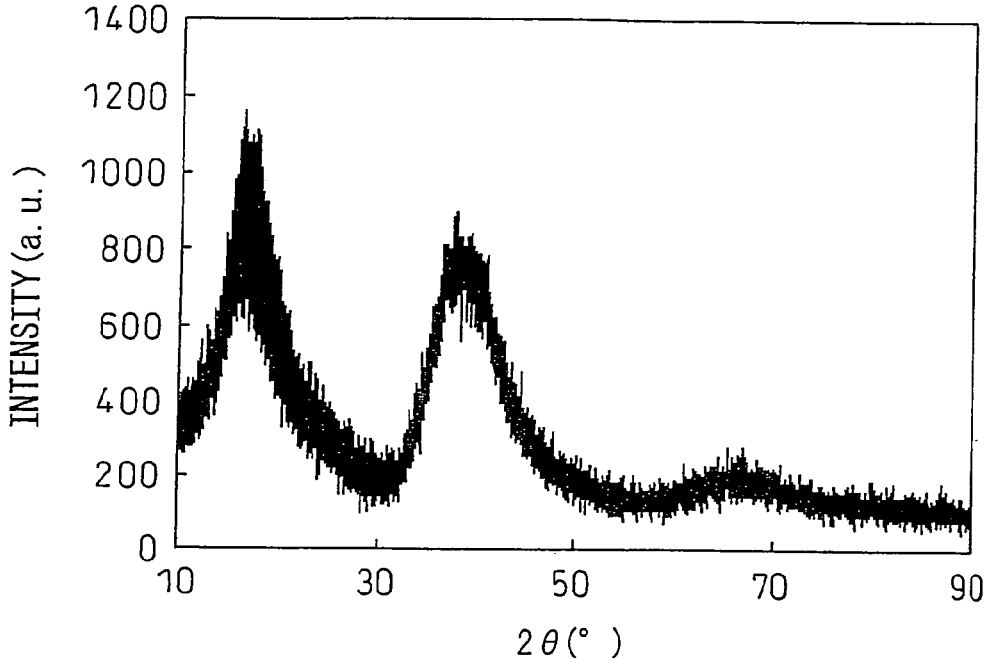
FIG. 3 is an X-ray diffraction chart of a thin strip sample of a Zn-50 atm % Mg-5 atm % Ca alloy obtained by the single roll method.

An X-ray diffraction chart of the fabricated thin strip sample by the thin film X-ray diffraction method is shown in FIG. 3. As shown in FIG. 3, the peak of the crystal phase disappeared and a halo pattern distinctive to formation of an amorphous phase was detected.

Example 3

Different metals (purity 99.9 mass % or more) were mixed in predetermined amounts and melted using a high frequency induction heating furnace in an Ar atmosphere at 600 to 1100° C., then were furnace cooled to obtain alloys of the chemical compositions of Nos. 1 to 48 shown in Table 1 and Table 2 (continuation of Table 1).

The chemical compositions of the different alloys were determined by ICP (inductively-coupled plasma) spectrometry using acid-solution dissolving swarf obtained from the alloys.

To fabricate amorphous samples of the alloys of the above chemical compositions, the single roll method was used.

Using an apparatus the same as the one used in Example 1, quartz crucibles having slit-shaped apertures (0.6 mm×20 mm) at their front ends were charged with 0.1 kg amounts of these alloys. The alloys were held at temperatures 80 to 200° C. higher than the melting points ($T_m$) for several minutes. The molten alloys were ejected at pressures of 0.02 to 0.03 MPa on Cu rolls (roll diameters 300 mm) rotated at peripheral speeds of 50 m/sec.

The distances between the apertures and roll surfaces at the time of ejection were 0.2 mm. The obtained amorphous thin strips had widths of 3 to 10 mm, lengths of 50 to 100 mm, and thicknesses of about 10 to 20 μm. Thin strip samples were fabricated from these.

TABLE 1

| | A | | | | | | | B | | | C | | | Tm | Tg | | Amorphous phase fraction by high pressure die | Rare earth | |
|---|---|---|---|---|---|---|---|---|---|---|---|---|---|---|---|---|---|---|---|
| No. | Ag | Al | Au | Cu | Ni | Si | Zn | Li | Mg | Sn | Ca | La | Y | (K) | (K) | Tg/Tm | casting | (La, Y used) | Class |
| 1 | | | | 65 | | | | | 25 | | 10 | | | 1041 | 645 | ◎(0.62) | Δ(69%) | — | Inv. |
| 2 | | | | 50 | | | | | 45 | | 5 | | | 1019 | 622 | ◎(0.61) | Δ(66%) | — | ex. |
| 3 | | 80 | | | | | | 10 | | | 10 | | | 942 | 537 | ○(0.57) | ○(79%) | — | |
| 4 | | 82 | | | | | | 10 | | | 8 | | | 928 | 529 | ○(0.57) | ○(80%) | — | |
| 5 | | 80 | | | | | | 12 | | | 8 | | | 924 | 527 | ○(0.57) | ○(80%) | — | |
| 6 | | 80 | | | | | | | 12 | | | | 8 | 1045 | 585 | ○(0.56) | ○(75%) | Yes | |
| 7 | | 75 | | | 5 | | | | 12 | | | | 8 | 1039 | 613 | ◎(0.59) | ○(88%) | Yes | |

TABLE 1-continued

| No. | A: Ag | A: Al | A: Au | A: Cu | A: Ni | A: Si | A: Zn | B: Li | B: Mg | B: Sn | C: Ca | C: La | C: Y | Tm (K) | Tg (K) | Tg/Tm | Amorphous phase fraction by high pressure die casting | Rare earth (La, Y used) | Class |
|---|---|---|---|---|---|---|---|---|---|---|---|---|---|---|---|---|---|---|---|
| 8 | | 79 | 1 | | | | | | 12 | | | | 8 | 1030 | 587 | ○(0.57) | ○(79%) | Yes | |
| 9 | 1 | 79 | | | | | | | 12 | | | | 8 | 1028 | 586 | ○(0.57) | ○(80%) | Yes | |
| 10 | | 75 | | 3 | 2 | | | | 12 | | | | 8 | 1025 | 605 | ◎(0.59) | ○(87%) | Yes | |
| 11 | | 80 | | | | | | | 10 | | 10 | | | 944 | 538 | ○(0.57) | ○(79%) | — | |
| 12 | | 75 | | | | | | | 18 | | 7 | | | 843 | 481 | ○(0.57) | ○(80%) | — | |
| 13 | | 75 | | | | | | | 20 | | | 5 | | 798 | 487 | ◎(0.61) | ◎(90%) | Yes | |
| 14 | | 70 | | | | | | | 20 | | 10 | | | 955 | 563 | ◎(0.59) | ◎(90%) | — | |
| 15 | | 70 | | | | | | | 25 | | 5 | | | 766 | 460 | ◎(0.6) | ◎(93%) | — | |
| 16 | | 65 | | | | | | | 25 | | 10 | | | 946 | 568 | ◎(0.6) | ◎(94%) | — | |
| 17 | | 60 | | | | | | | 30 | | 10 | | | 949 | 560 | ◎(0.59) | ○(89%) | — | |
| 18 | | 50 | | | | | | | 45 | | 5 | | | 775 | 457 | ◎(0.59) | ○(88%) | — | |
| 19 | | 45 | | | | | | | 50 | | 5 | | | 780 | 460 | ◎(0.59) | ○(88%) | — | |
| 20 | | 40 | | | | | | | 55 | | 5 | | | 781 | 461 | ◎(0.59) | ○(88%) | — | |
| 21 | | | | | | | 80 | | 13 | | 7 | | | 809 | 396 | Δ(0.49) | — | — | |
| 22 | | | | | | | 75 | | 17 | 1 | 7 | | | 812 | 398 | Δ(0.49) | — | — | |
| 23 | | | | | | | 70 | | 23 | | 7 | | | 745 | 380 | Δ(0.51) | — | — | |
| 24 | | | | 5 | | | 65 | | 23 | | 7 | | | 736 | 383 | □(0.52) | — | — | |
| 25 | 1 | | | | | | 69 | | 23 | | 7 | | | 742 | 386 | □(0.52) | — | — | |

TABLE 2

(Continuation of Table 1)

| No. | A: Ag | A: Al | A: Au | A: Cu | A: Ni | A: Si | A: Zn | B: Li | B: Mg | B: Sn | C: Ca | C: La | C: Y | Tm (K) | Tg (K) | Tg/Tm | High pressure die cast amorphous phase fraction | Rare earth (La, Y used) | Class |
|---|---|---|---|---|---|---|---|---|---|---|---|---|---|---|---|---|---|---|---|
| 26 | | | 1 | | | | 69 | | 23 | | 7 | | | 742 | 386 | □(0.52) | — | — | Inv. |
| 27 | | | | | | | 65 | | 25 | | 10 | | | 739 | 384 | □(0.52) | — | — | ex. |
| 28 | | | | | | | 60 | | 35 | | 5 | | | 736 | 390 | □(0.53) | — | — | |
| 29 | | | | | | | 55 | | 40 | | 5 | | | 663 | 345 | □(0.52) | — | — | |
| 30 | | | | | | | 50 | | 47 | | 3 | | | 618 | 340 | Δ(0.55) | — | — | |
| 31 | | | | | | | 50 | | 45 | | 5 | | | 619 | 340 | Δ(0.55) | — | — | |
| 32 | | | | | | | 50 | | 45 | | | 5 | | 623 | 343 | ◇(0.55) | — | — | |
| 33 | | | | | | | 50 | | 45 | | | | 5 | 769 | 415 | ◇(0.54) | — | — | |
| 34 | | | | | | | 45 | | 45 | | 10 | | | 652 | 359 | ◇(0.55) | — | — | |
| 35 | | | | | | | 45 | | 50 | | 5 | | | 646 | 355 | ◇(0.55) | — | — | |
| 36 | | | | | | | 40 | | 50 | | 10 | | | 645 | 355 | ◇(0.55) | — | — | |
| 37 | | | | | | | 40 | | 55 | | 5 | | | 644 | 354 | ◇(0.55) | — | — | |
| 38 | | | | | 5 | | 50 | | 40 | | 5 | | | 671 | 362 | ◇(0.54) | — | — | |
| 39 | | | | | 3 | | 52 | | 40 | | 5 | | | 667 | 367 | ◇(0.55) | — | — | |
| 40 | | | | | 2 | | 53 | | 40 | | 5 | | | 665 | 352 | □(0.53) | — | — | |
| 41 | | | | | 0.2 | | 54.8 | | 40 | | 5 | | | 665 | 352 | □(0.53) | — | — | |
| 42 | | | | | 0.05 | | 54.95 | | 40 | | 5 | | | 663 | 345 | □(0.52) | — | — | |
| 43 | | | | | | | 50 | | 25 | | 25 | | | 746 | 366 | X(0.47) | — | — | C. |
| 44 | | | | | | | 90 | | 5 | | 5 | | | 783 | — | — | — | — | ex. |
| 45 | | | | | | | 40 | | 35 | | 25 | | | 745 | 358 | X(0.48) | — | — | |
| 46 | | 60 | | | | | | | 20 | | 20 | | | 1078 | 474 | X(0.44) | — | — | |
| 47 | | | | 65 | | | | | 25 | 10 | | | | 998 | — | — | — | — | |
| 48 | | | | 50 | | | | | 45 | 5 | | | | 896 | — | — | — | — | |

The obtained thin strip samples were used to obtain X-ray diffraction charts by the X-ray diffraction method. In the alloys of the present invention composition, that is, Nos. 1 to 42, diffraction peaks due to the crystal phases were not detected. Only halo patterns due to the amorphous phases were detected.

On the other hand, in Nos. 43 to 48 not included in the range of composition of the alloy of the present invention, broad diffraction peaks showing that the crystal phases remained were detected. Even if fabricating thin strip samples by the single roll method, it was learned that the amorphous forming abilities were low with the crystal phases remaining.

These thin strip samples were buried in resin, polished by emery paper, buffed, then etched. An optical microscope was used to measure the areas of the crystal phases of the cross-sections of the thin strip samples.

In Nos. 43, 45, and 46, amorphous phases were detected but the amorphous volume fractions were less than 50%. Further, Nos. 44, 47, and 48 were completely crystalline.

About 5 mg amounts of cut pieces of the thin strip samples were taken, analyzed by a differential scanning calorimeter (DSC), and measured for $T_g/T_m$ ratio. The rate of temperature rise was 40° C./min.

In Table 1 and Table 2, samples with a $T_g/T_m$ ratio of less than 0.49 are indicated as "x", with a ratio of 0.49 to 0.52 as "Δ", with a ratio of 0.52 to 0.54 as "□", with a ratio of 0.54 to 0.56 as "◇", with a ratio of 0.56 to 0.58 as "○", and with a ratio of 0.58 or more as "◎".

Among the prepared alloys, alloys with a $T_g/T_m$ ratio of 0.56 or more (Nos. 1 to 20) were used to fabricate quenched solidified pieces using a copper casting mold and high pressure die-casting. These were fabricated by holding the alloys at temperatures 30 to 100° C. higher than the melting point for several minutes and ejecting them at pressures of 0.07 MPa. The obtained quenched solidified pieces had a size of 30×30 mm and thickness of 2 mm.

These solidified piece were used for X-ray diffraction analysis in the plate state, and it could be confirmed that the surface layers of the solidified pieces were completely amorphous.

The fabricated 2 mm thickness solidified pieces were cut at their center parts, polished by emery paper, buffed, then etched. An optical microscope was used to measure the areas of the crystal phases of the cross-sections of the solidified piece.

Among the alloys with low amorphous forming abilities, there were ones where a crystal phase was detected at the centers of the cross-sections of the solidified pieces.

In the Al-based alloys, ones with a $T_g/T_m$ ratio of 0.6 or more gave almost complete single amorphous phases. In ones with a ratio less than 0.58, when the $T_g/T_m$ ratios became smaller, the ratios of the crystal phase in the cross-sectional area became greater.

If the $T_g/T_m$ ratios differ by 0.01, the amorphous volume fractions in the cross-sectional area differ by around 3 to 5%.

In Table 1 and Table 2, samples with a volume fraction of 50 to 70% are indicated as "Δ", with 70 to 90% as "○", and with 90% or more as "◎".

The alloys of the invention examples were all higher in glass forming ability compared with the alloys of the comparative example alloys. Further, in the Zn or Al-based alloys of the present invention, by utilizing Mg and Ca, it became possible to get amorphous forming abilities and form amorphous alloys without regard as to the rare earth elements. By not using any rare earth elements, it becomes possible to lower the alloy costs.

Among these as well, alloys containing Zn or Al in amounts of 20 to 85 atm %, Mg in amounts of 10 to 79.7 atm %, and Ca in amounts of 0.3 to 15 atm % have higher $T_g/T_m$ ratios and more superior amorphous forming abilities compared with Zn—Mg—Ca-based alloys or Al—Mg—Ca-based alloys outside these ranges of composition.

Alloys to which Au, Ag, Cu, Ni, etc. are added in amounts of 0.1 to 7 atm % have further higher $T_g/T_m$ ratios and have more superior amorphous forming abilities compared with alloys to which these are not added.

Example 4

Alloys of the compositions shown by Nos. 3 to 5 and Nos. 11 to 42 of Table 1 and Table 2 and Nos. 51 to 61 of Table 3 and Table 4 (continuation of Table 3) were hot dip plated on metal materials.

The metal materials used for the plating substrates were cold rolled steel plate of a plate thickness of 0.8 mm, copper plate of a plate thickness of 0.5 mm, equal angle steel of a thickness of 10 mm and a length of a side of 10 cm, and hot rolled steel plate of a plate thickness of 10 mm.

The cold rolled steel plate and copper plate were cut into 10 cm×10 cm specimens, the equal angle steel was cut into specimens of 10 cm in the longitudinal direction, and the hot rolled steel plate was cut into squares of 10 cm×10 cm for use as plating substrates.

Nos. 56 to 61 are comparative examples, that is, all crystalline Al-20 atm % Mg-10 atm % Ca plated steel plate (No. 56), Zn-45 atm % Mg-5 atm % Ca plated steel plate (No. 57), Zn-11 atm % Al-plated steel plate (No. 58), galvanized steel plate (No. 59), Al-25 atm % Zn plated steel plate (No. 60), and Al-10 atm % Si-plated steel plate (No. 61).

TABLE 3

| | Steel material | A | | | | | | | B | | | C | | | Tm | Tg | |
|---|---|---|---|---|---|---|---|---|---|---|---|---|---|---|---|---|---|
| No. | class | Ag | Al | Au | Cu | Ni | Si | Zn | Li | Mg | Sn | Ca | La | Y | (K) | (K) | Tg/Tm |
| 3 | Cold | | 80 | | | | | | 10 | | | 10 | | | 942 | 537 | ○(0.57) |
| 4 | rolled | | 82 | | | | | | 10 | | | 8 | | | 928 | 529 | ○(0.57) |
| 5 | steel | | 80 | | | | | | 12 | | | 8 | | | 924 | 527 | ○(0.57) |
| 11 | plate | | 80 | | | | | | | 10 | | 10 | | | 944 | 538 | ○(0.57) |
| 12 | | | 75 | | | | | | | 18 | | 7 | | | 843 | 481 | ○(0.57) |
| 13 | | | 75 | | | | | | | 20 | | | 5 | | 798 | 487 | ◎(0.61) |
| 14 | | | 70 | | | | | | | 20 | | 10 | | | 955 | 563 | ◎(0.59) |
| 15 | | | 70 | | | | | | | 25 | | 5 | | | 766 | 460 | ◎(0.6) |
| 16 | | | 65 | | | | | | | 25 | | 10 | | | 946 | 568 | ◎(0.6) |
| 17 | | | 60 | | | | | | | 30 | | 10 | | | 949 | 560 | ◎(0.59) |
| 18 | | | 50 | | | | | | | 45 | | 5 | | | 775 | 457 | ◎(0.59) |
| 19 | | | 45 | | | | | | | 50 | | 5 | | | 780 | 460 | ◎(0.59) |
| 20 | | | 40 | | | | | | | 55 | | 5 | | | 781 | 461 | ◎(0.59) |
| 21 | | | | | | | | 80 | | 13 | | 7 | | | 809 | 396 | Δ(0.49) |
| 22 | | | | | | | | 75 | | 17 | 1 | 7 | | | 812 | 398 | Δ(0.49) |
| 23 | | | | | | | | 70 | | 23 | | 7 | | | 745 | 380 | Δ(0.51) |
| 24 | | | | | 5 | | | 65 | | 23 | | 7 | | | 736 | 383 | □(0.52) |
| 25 | | 1 | | | | | | 69 | | 23 | | 7 | | | 742 | 386 | □(0.52) |
| 26 | | | | 1 | | | | 69 | | 23 | | 7 | | | 742 | 386 | □(0.52) |
| 27 | | | | | | | | 65 | | 25 | | 10 | | | 739 | 384 | □(0.52) |
| 28 | | | | | | | | 60 | | 35 | | 5 | | | 736 | 390 | □(0.53) |
| 29 | | | | | | | | 55 | | 40 | | 5 | | | 663 | 345 | □(0.52) |
| 30 | | | | | | | | 50 | | 47 | | 3 | | | 618 | 340 | ◇(0.55) |

| No. | Amount of deposition g/m² | Amorphous phases volume fraction of plated layer | Amorphous phase of surface layer of plating | Corrosion resistance | Heat reflectance | Heat reflectance after heat treatment (200° C., 24 h) | Cllass |
|---|---|---|---|---|---|---|---|
| 3 | 10 | ◎(90%) | ○ | ◎ | 0.84 | 0.72 | Inv. |
| 4 | 10 | ◎(90%) | ○ | ◎ | 0.83 | 0.73 | ex, |

TABLE 3-continued

| | | | | | | |
|---|---|---|---|---|---|---|
| 5 | 10 | ◎(90%) | ○ | ◎ | 0.83 | 0.72 |
| 11 | 15 | ◎(90%) | ○ | ◎ | 0.86 | 0.81 |
| 12 | 15 | ◎(90%) | ○ | ◎ | 0.83 | 0.79 |
| 13 | 30 | ◎(93%) | ○ | ◎ | 0.87 | 0.77 |
| 14 | 20 | ◎(97%) | ○ | ◎ | 0.84 | 0.8 |
| 15 | 20 | ◎(100%) | ○ | ◎ | 0.83 | 0.65 |
| 16 | 40 | ◎(92%) | ○ | ◎ | 0.83 | 0.78 |
| 17 | 45 | ◎(90%) | ○ | ◎ | 0.84 | 0.72 |
| 18 | 15 | ◎(97%) | ○ | ◎ | 0.84 | 0.65 |
| 19 | 40 | ◎(91%) | ○ | ◎ | 0.84 | 0.65 |
| 20 | 40 | ◎(90%) | ○ | ◎ | 0.84 | 0.65 |
| 21 | 25 | Δ(54%) | ○ | ◎ | 0.81 | 0.41 |
| 22 | 25 | Δ(56%) | ○ | ◎ | 0.81 | 0.44 |
| 23 | 25 | Δ(65%) | ○ | ◎ | 0.8 | 0.43 |
| 24 | 25 | ○(71%) | ○ | ◎ | 0.8 | 0.4 |
| 25 | 25 | ○(70%) | ○ | ◎ | 0.8 | 0.4 |
| 26 | 25 | ○(70%) | ○ | ◎ | 0.81 | 0.4 |
| 27 | 25 | ○(71%) | ○ | ◎ | 0.8 | 0.41 |
| 28 | 25 | ○(76%) | ○ | ◎ | 0.82 | 0.4 |
| 29 | 25 | ○(72%) | ○ | ◎ | 0.77 | 0.4 |
| 30 | 50 | Δ(64%) | ○ | ◎ | 0.83 | 0.4 |

TABLE 4

(Continuation of Table 3

| | Steel material | A | | | | | | | B | | | C | | | Tm | Tg | |
|---|---|---|---|---|---|---|---|---|---|---|---|---|---|---|---|---|---|
| No. | class | Ag | Al | Au | Cu | Ni | Si | Zn | Li | Mg | Sn | Ca | La | Y | (K) | (K) | Tg/Tm |
| 31 | | | | | | | | 50 | | 45 | | 5 | | | 619 | 340 | ◇(0.55) |
| 32 | | | | | | | | 50 | | 45 | | | 5 | | 623 | 343 | ◇(0.55) |
| 33 | | | | | | | | 50 | | 45 | | | | 5 | 769 | 415 | ◇(0.54) |
| 34 | | | | | | | | 45 | | 45 | | 10 | | | 652 | 359 | ◇(0.55) |
| 35 | | | | | | | | 45 | | 50 | | 5 | | | 646 | 355 | ◇(0.55) |
| 36 | | | | | | | | 40 | | 50 | | 10 | | | 645 | 355 | ◇(0.55) |
| 37 | | | | | | | | 40 | | 55 | | 5 | | | 644 | 354 | ◇(0.55) |
| 38 | | | | | | 5 | | 50 | | 40 | | 5 | | | 671 | 362 | ◇(0.54) |
| 39 | | | | | | 3 | | 52 | | 40 | | 5 | | | 667 | 367 | ◇(0.55) |
| 40 | | | | | | 2 | | 53 | | 40 | | 5 | | | 665 | 352 | □(0.53) |
| 41 | | | | | | 0.2 | | 54.8 | | 40 | | 5 | | | 665 | 352 | □(0.53) |
| 42 | | | | | | 0.05 | | 54.95 | | 40 | | 5 | | | 663 | 345 | □(0.52) |
| 51 | Copper plate | | | | | | | 50 | | 45 | | 5 | | | 619 | 340 | ◇(0.55) |
| 52 | Hot | | | | | | | 50 | | 45 | | 5 | | | 619 | 340 | ◇(0.55) |
| 53 | rolled steel plate | | 80 | | | | | | | 10 | | 10 | | | 944 | 529 | ○(0.56) |
| 54 | Equal | | | | | | | 50 | | 45 | | 5 | | | 619 | 340 | ◇(0.55) |
| 55 | angle steel | | 80 | | | | | | | 10 | | 10 | | | 944 | 529 | ○(0.56) |
| 56 | Cold | | 70 | | | | | | | 20 | | 10 | | | 955 | — | — |
| 57 | rolled | | | | | | | 50 | | 45 | | 5 | | | 619 | — | — |
| 58 | steel | | 11 | | | | | 89 | | | | | | | 625 | — | — |
| 59 | plate | | | | | | | 100 | | | | | | | 688 | — | — |
| 60 | | | 75 | | | | | 25 | | | | | | | 860 | — | — |
| 61 | | | 90 | | | | 10 | | | | | | | | 861 | — | — |

| | No. | Amount of deposition g/m$^2$ | Amorphous phases volume fraction of plated layer | Amorphous phase of surface layer of plating | Corrosion resistance | Heat reflectance | Heat reflectance after heat treatment (200° C., 24 h) | Class |
|---|---|---|---|---|---|---|---|---|
| | 31 | 25 | ◎(90%) | ○ | ◎ | 0.81 | 0.4 | Inv. |
| | 32 | 60 | ○(75%) | ○ | ◎ | 0.76 | 0.39 | ex. |
| | 33 | 90 | Δ(69%) | ○ | ◎ | 0.77 | 0.38 | |
| | 34 | 25 | ○(89%) | ○ | ◎ | 0.76 | 0.35 | |
| | 35 | 25 | ◎(90%) | ○ | ◎ | 0.82 | 0.4 | |
| | 36 | 20 | ◎(90%) | ○ | ◎ | 0.79 | 0.42 | |
| | 37 | 25 | ◎(90%) | ○ | ◎ | 0.82 | 0.4 | |
| | 38 | 60 | Δ(62%) | ○ | ◎ | 0.79 | 0.4 | |
| | 39 | 30 | ○(89%) | ○ | ◎ | 0.8 | 0.4 | |
| | 40 | 25 | ○(75%) | ○ | ◎ | 0.8 | 0.4 | |
| | 41 | 25 | ○(75%) | ○ | ◎ | 0.8 | 0.4 | |
| | 42 | 25 | ○(70%) | ○ | ◎ | 0.77 | 0.4 | |

TABLE 4-continued (Continuation of Table 3

| | | | | | | | |
|---|---|---|---|---|---|---|---|
| 51 | 30 | Δ(69%) | ○ | ◎ | 0.77 | 0.25 | |
| 52 | 120 | Δ(69%) | ○ | ◎ | 0.78 | 0.4 | |
| 53 | 50 | Δ(68%) | ○ | ◎ | 0.85 | 0.81 | |
| 54 | 150 | Δ(53%) | ○ | ◎ | 0.78 | 0.41 | |
| 55 | 70 | Δ(66%) | ○ | ◎ | 0.85 | 0.8 | |
| 56 | 15 | X(0%) | X | ○ | 0.75 | 0.72 | C. |
| 57 | 25 | X(0%) | X | Δ | 0.74 | 0.38 | ex. |
| 58 | 25 | X(0%) | X | Δ | 0.74 | 0.52 | |
| 59 | 25 | X(0%) | X | X | 0.72 | 0.43 | |
| 60 | 15 | X(0%) | X | ○ | 0.76 | 0.72 | |
| 61 | 20 | X(0%) | X | ○ | 0.69 | 0.66 | |

The cold rolled steel plate and copper plate were degreased, then plated by a batch type hot dip plating apparatus made by Rhesca. The cold rolled steel plate was annealed at a dew point −60° C. $N_2$-5% $H_2$ at 800° C. for 60 seconds.

After annealing, the plate was cooled to the bath temperature and dipped in the plating bath. The copper plate was raised in temperature in $N_2$-5% $H_2$ to the bath temperature and immediately dipped into the plating bath.

The temperature of the plating baths was standardized at the melting point of the plating alloy +50° C. in accordance with the plating alloy composition. Air wiping was used to adjust the coating masses, then the cooling start temperature was set at the melting point +1 to +10° C. and the plates were cooled by −150° C. low temperature nitrogen gas. The amorphous volume fractions changed according to the plating compositions and the coating masses.

Further, the plated metal materials of the comparative examples comprised of alloys of the compositions of the present invention, but comprised of crystal phases (No. 56, No. 57) were air wiped, then air-cooled.

The equal angle steel and hot rolled steel plate were degreased, pickled by sulfuric acid, then hot dip plated using a crucible furnace by the flux method. Right after plating, these were cooled by liquid nitrogen.

For Al-based hot dip plating, first plating by a Zn-0.2% Al plating bath was performed by the usual flux method, then a plating bath of the target composition was used for second plating.

In this case, the amount of deposition becomes the total of the amounts of deposition of the first and second platings, but part of the first plating dissolves at the time of the second plating, so the amount of deposition was made the total amount of the plating finally present on the substrate.

Said alloy-plated metal materials were used for the evaluation test explained below. The amount of deposition of the plating was measured by the loss of mass upon dissolving the plating layer in an acid. The alloy components in the plating was assayed by ICP (inductively-coupled plasma) spectrometry using acid solutions dissolving swarf obtained from the alloys.

However, in hot dip plating, the alloy layer easily grows, so the plating layer was separately dissolved by a pickling time of 80% of the pickling time required for measurement of the amount of deposition to prepare a sample for analysis of the composition of the plated surface layer.

As a result, in the alloy composition and plating composition used, the error was within 0.5 atm %. It could be confirmed that there was no deviation in the composition.

For the amorphous volume fraction of the plating layer, two thin sections for transmission electron microscope use were taken at each of the positions of the thickness of the plating layer of the test piece divided into five equal parts, image analysis using computer was used to measure the area ratios of the amorphous regions in each of the fields, and the average value of the area ratios of the amorphous regions in all fields were used as the amorphous volume fraction.

If plating by the same amount of deposition, if the $T_g/T_m$ ratio is different by 0.01, the amorphous volume fraction differs by 3 to 5%.

In Table 3 and Table 4, a sample with an amorphous volume fraction of the plating layer of less than 50% is indicated as "x", one of 50 to 70% is indicated as "Δ", one of 70 to 90% is indicated as "○", and one of 90% or more is "◎".

The mode of formation of the amorphous phase at the surface layer of the plating layer was judged by obtaining an X-ray diffraction chart at an incident angle of 1° by a thin film X-ray diffraction apparatus of a parallel optical system using the Kα-X-rays of Cu and observing for the presence of a diffraction peak due to a crystal phase.

Figure 4:
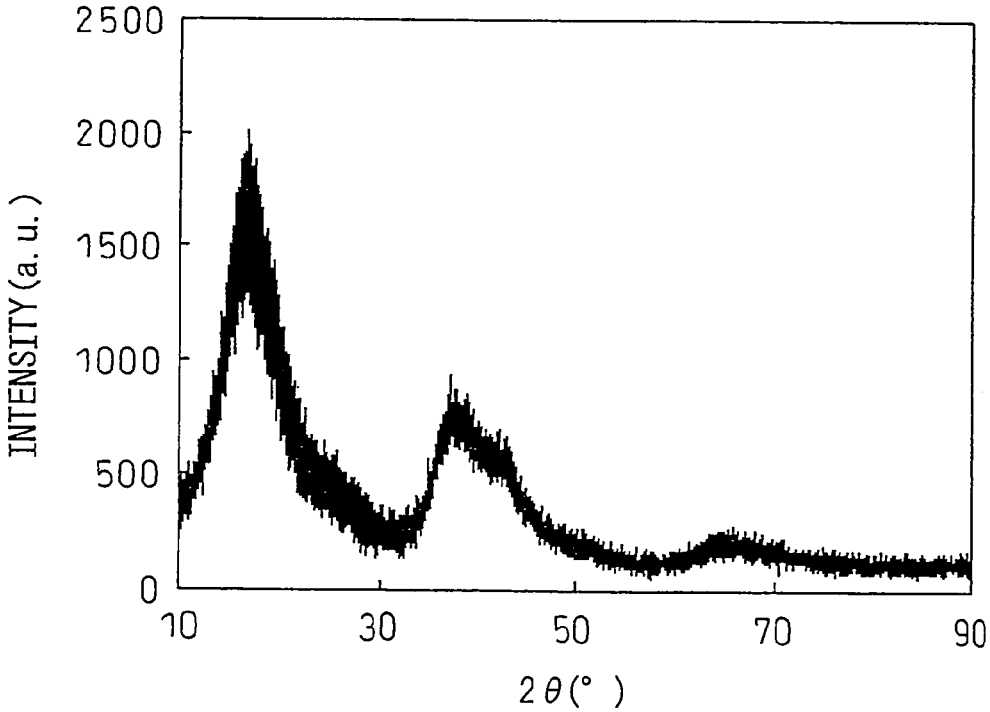
FIG. 4 is an X-ray diffraction chart of the plated surface layer of the No. 35 plated steel plate of Table 2.

An X-ray diffraction chart at the plating layer surface layer of the No. 35 plated steel plate in Table 2 is shown in FIG. 4. As shown in FIG. 4, due to the amorphous phase of the plating layer surface layer, the peak of the crystal phase disappears and a halo pattern distinctive to the amorphous phase is detected.

A peak having a peak height of 50% or more of the background intensity and having a half value width of that peak of 1° or less is defined as the diffraction peak due to the crystal phase. A sample with no diffraction peak due to the crystal phase detected was judged to have a surface layer which is completely amorphous and was indicated by "○", while a sample with a diffraction peak due to the crystal phase detected was judged to have a crystal phase present at the surface layer and was indicated by "x".

The corrosion test was performed based on the salt spray test (SST) described in JIS-Z-2371.

The corrosion loss after running a test with a saltwater concentration of 10 g/liter for 3000 hours was evaluated. A sample with a corrosion loss of less than 2 g/$m^2$ was indicated as "◎", with 2 to 5 g/$m^2$ was indicated as "○", and with 5 g/$m^2$ or more was indicated as "x".

Further, all plating samples were measured for heat reflectance. The heat reflectances of the plating layers were measured using a heat reflectance measurement apparatus.

This measurement apparatus is comprised of a light projector using a solar simulation lamp (150 W, 17V made by Philips Japan) as a light source, an infrared region integrating sphere (diameter of 51 cm, inner metal diffusion surface made by Labshere), and a prototype radiometer using a thermopile (MIR-1000Q made by Mitsubishi Yuka) as a sensor.

An "infrared integrating sphere" is a device comprised of a sphere plated with gold on its inner surface to make it a high reflectance diffusion surface and provided with a light entry port and an inside observation port.

The pseudo sunlight emitted from a lamp was condensed by a concave mirror and emitted toward a sample in the integrating sphere. Reflection at the sample surface occurs in all directions, but is condensed at the radiometer by multiple diffusion and reflection inside the integrating sphere. The output voltage of the radiometer is proportional to the intensity of the entire reflected light.

The DC output voltage Vo of the radiometer at the time when not emitting light is measured. First, light was illuminated at a gold vapor deposited mirror (ϕ65 mm) with a heat reflectance deemed to be 1 and the output voltage Vm of the radiometer was measured. Next, the output voltage Vs when firing light at a plating sample (ϕ65 mm) was measured.

Using the measurement values Vo, Vm, and Vs, the heat reflectance r was found from the equation r=(Vs−Vo)/(Vm−Vo). Each sample was measured 10 or more times and average used as the heat reflectance of that sample. The measurement results are shown in Table 3 and Table 4.

Further, each sample was heat treated in an Ar atmosphere at 200° C. for 24 hours, then again measured for heat reflectance. The results are also shown in Table 3 and Table 4.

The corrosion resistance of the plated metal material due to the alloy of the composition of the present invention was better in all cases compared with the comparative metal materials. Further, the Zn-based metal material of the present invention has a higher heat reflectance compared with the Zn-based comparative metal material, further the Al-based metal material of the present invention has a higher heat reflectance than an Al-based comparative metal material.

In particular, the Al-based metal material of the present invention can maintain a high heat reflectance even after heat treatment.

Example 5

The Nos. 27 to 31, 35, and 37 alloys were used and hot dip plated. After hot dip plating, they were cooled by liquid nitrogen gas to fabricate plated steel plates with different volume fractions of amorphous phases. When fabricating crystalline plated steel plates, hot dip plating, then air cooling are sufficient.

The volume fraction of the amorphous phase can be adjusted by dipping the steel plates in the plating bath, then lifting up the steel plates and adjusting the steel plate temperature at the point when starting the cooling by liquid nitrogen gas.

That is, by making the steel plate temperature at the point when starting the cooling by liquid nitrogen gas a temperature 1 to 10° C. lower than the melting point of the plating bath, part of the plating layer is crystallized and the rest is maintained in the supercooled state.

If performing the liquid nitrogen air cooling in this semi-crystalline state, the part in the supercooled state becomes the amorphous phase as it is. The amount of crystallization become's greater the lower the cooling start temperature and the greater the longer the holding time at that temperature.

Plated steel plates with different volume fractions of amorphous phases were fabricated by controlling the cooling start temperature and holding time.

The fabricated plated steel plates were subjected to a cyclic corrosion test. The corrosion test consisted of 21 cycles of the method based on automobile standards (JASO M 609-91, 8 hours, wet/dry-time ratio=50%).

However, for the saltwater, 0.5% saltwater was used. The corrosion resistance was evaluated by corrosion thickness reduction converted from the density and the corrosion mass loss after corrosion.

A corrosion thickness reduction of less than 1 μm was evaluated as "◎" (very good), 1 to 2 μm as "○" (good), 2 to 4 μm as "◇" (fair), and 4 μm or more as "x" (poor). Table 5 shows the corrosion resistance of the alloy plated steel plates.

TABLE 5

| | A | | | | | | | B | | | C | | | Tm | Tg | | Amount of deposition | Amorphous phases volume fraction of plated | Corro-sion resis- |
|---|---|---|---|---|---|---|---|---|---|---|---|---|---|---|---|---|---|---|---|
| No. | Ag | Al | Au | Cu | Ni | Si | Zn | Li | Mg | Sn | Ca | La | Y | (K) | (K) | Tg/Tm | g/m$^2$ | layer | tance |
| 27 | | | | | | | 65 | | 25 | | 10 | | | 739 | 384 | □(0.52) | 25 | ○(71%) | ◎ |
| | | | | | | | | | | | | | | | | | 25 | X(27%) | ○ |
| | | | | | | | | | | | | | | | | | 25 | X(0%) | X |
| 28 | | | | | | | 60 | | 35 | | 5 | | | 736 | 390 | □(0.53) | 25 | ○(76%) | ○ |
| | | | | | | | | | | | | | | | | | 25 | X(25%) | ◇ |
| | | | | | | | | | | | | | | | | | 25 | X(0%) | X |
| 29 | | | | | | | 55 | | 40 | | 5 | | | 663 | 345 | □(0.52) | 25 | ○(72%) | ◎ |
| | | | | | | | | | | | | | | | | | 25 | X(18%) | ○ |
| | | | | | | | | | | | | | | | | | 25 | X(0%) | ◇ |
| 30 | | | | | | | 50 | | 47 | | 3 | | | 618 | 340 | ◇(0.55) | 25 | Δ(64%) | ◎ |
| | | | | | | | | | | | | | | | | | 25 | X(10%) | ○ |
| | | | | | | | | | | | | | | | | | 25 | X(0%) | ◇ |
| 31 | | | | | | | 50 | | 45 | | 5 | | | 619 | 340 | ◇(0.55) | 25 | ◎(90%) | ◎ |
| | | | | | | | | | | | | | | | | | 25 | X(25%) | ○ |
| | | | | | | | | | | | | | | | | | 25 | X(0%) | ◇ |
| 35 | | | | | | | 45 | | 50 | | 5 | | | 646 | 355 | ◇(0.55) | 25 | ◎(90%) | ◎ |
| | | | | | | | | | | | | | | | | | 25 | X(3%) | ○ |
| | | | | | | | | | | | | | | | | | 25 | X(0%) | ◇ |
| 37 | | | | | | | 40 | | 55 | | 5 | | | 644 | 354 | ◇(0.55) | 25 | ◎(90%) | ◎ |
| | | | | | | | | | | | | | | | | | 25 | X(5%) | ○ |
| | | | | | | | | | | | | | | | | | 25 | X(0%) | ◇ |

As shown in Table 5, plated steel plate containing an amorphous phase in a volume fraction of 5% or more in the plating layer is superior in corrosion resistance to plated steel plate having a crystalline plating layer of the same composition of components. Further, plated steel plate containing an amorphous phase in a volume fraction of 50% or more in the plating layer is more superior in corrosion resistance.

Example 6

Cold rolled steel plates of plate thicknesses of 0.8 mm (substrates) were dipped in baths of the plating compositions shown in Table 6 to fabricate surface treated steel plates.

The Mg, Zn, Ca, and other necessary component elements were adjusted to predetermined compositions, then a high frequency induction furnace was used to melt them in an Ar atmosphere to obtain alloys.

Cutting swarf was taken from each of the prepared alloys, then the cutting swarf was dissolved in acid. The solution assayed by ICP (inductively-coupled plasma) spectrometry to confirm that the fabricated alloy matched the composition shown in Table 6. This alloy was used as a plating bath.

The cold rolled steel plates (plate thickness 0.8 mm) were cut into 10 cm×10 cm specimens which were then plated by a batch type hot dip plating apparatus made by Rhesca. The bath temperature of the plating bath was 500° C. Air wiping was used to adjust the coating masses, then the specimens were immersed in 0° C. water.

The formation of an amorphous phase at the surface layer of the plating layer was judged by using an X-ray diffraction apparatus using the Kα-X-rays of Cu for measurement of the diffraction chart and judging the existence of a halo pattern.

For plated steel plates judged to have amorphous phases, to find the volume fraction of the amorphous phase quantitatively, the plated steel material was cut along the cross-section, then was polished and etched and the plating layer of the surface was observed by an optical microscope (X1000).

The area ratios of the amorphous phase were found by image processing by computer for 10 or more different fields and were averaged to obtain the volume fraction.

The fabricated plated steel plate was subjected to a cyclic corrosion test. The corrosion test consisted of 21 cycles of the method based on automobile standards (JASO M 609-91, 8 hours, wet/dry time ratio=50%). However, for the saltwater, 0.5% saltwater was used. The corrosion resistance was evaluated by corrosion thickness reduction converted from the density and the corrosion mass loss after corrosion.

A corrosion thickness reduction of less than 1 μm was evaluated as "◎" (very good), 1 to 2 μm as "○" ((good), 2 to 4 μm as "◇" (fair), and 4 μm or more as "x" (poor). Table 6 shows the corrosion resistance of the fabricated alloy plated steel plates.

Figure 5:
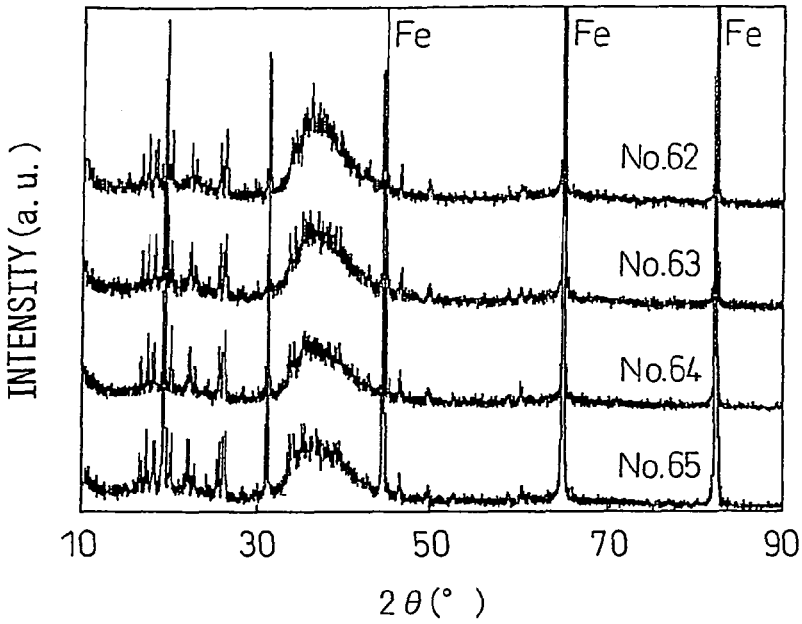
FIG. 5 is an X-ray diffraction chart of the plated surface layers of the Nos. 62 to 65 plated steel plates of Table 6.

FIG. 5 shows X-ray diffraction charts of the plated surface layers of No. 62 to 64 in Table 6. In each diffraction chart, a halo pattern was detected, showing the existence of an amorphous phase.

TABLE 6

| | A | | | | | | | B | | | C | | | Production | Amount of deposition | Amorphous phases volume fraction of plated | Corrosion resistance |
|---|---|---|---|---|---|---|---|---|---|---|---|---|---|---|---|---|---|
| No. | Ag | Al | Au | Cu | Ni | Si | Zn | Li | Mg | Sn | Ca | La | Y | method | $g/m^2$ | layer | |
| 62 | | | | | | | 30 | | 65 | | 5 | | | Water cooling | 10 | ◎(91%) | ◎ |
| 63 | | 1.0 | | | | | 29 | | 65 | | 5 | | | Water cooling | 10 | ◎(90%) | ◎ |
| 64 | | 2.8 | | | | | 27 | | 65.2 | | 5 | | | Water cooling | 20 | ◎(90%) | ◎ |
| 65 | | 4.4 | | | | | 25 | | 65.6 | | 5 | | | Water cooling | 20 | ◎(91%) | ◎ |
| 66 | | 1 | | | | | 24 | | 70 | | 5 | | | Water cooling | 20 | ◎(96%) | ◎ |
| 67 | | 2 | | | | | 23 | | 70 | | 5 | | | Water cooling | 20 | ◎(94%) | ◎ |
| 68 | | 4 | | | | | 21 | | 70 | | 5 | | | Water cooling | 20 | ◎(90%) | ◎ |
| 69 | | 1 | | | | | 30 | | 68.3 | | 0.7 | | | Water cooling | 10 | X(23%) | ○ |
| •70 | | 1 | | | | | 30 | | 67.5 | | 1.5 | | | Water cooling | 10 | X(25%) | ○ |
| 71 | | 1 | | | | | 32 | | 64.7 | | 2.3 | | | Water cooling | 10 | X(16%) | ○ |

Example 7

Zn, Al, Mg, and Ca metal reagents (purity 99.9 mass % or more) were mixed and melted using a high frequency induction furnace in an Ar atmosphere at 600° C., then furnace cooled to obtain the alloys of the compositions shown in Table 7.

These alloys were remelted in the atmosphere, then 1 cc amounts of the melts were scooped up and immersed in a 10 liter water tank.

Figure 6:
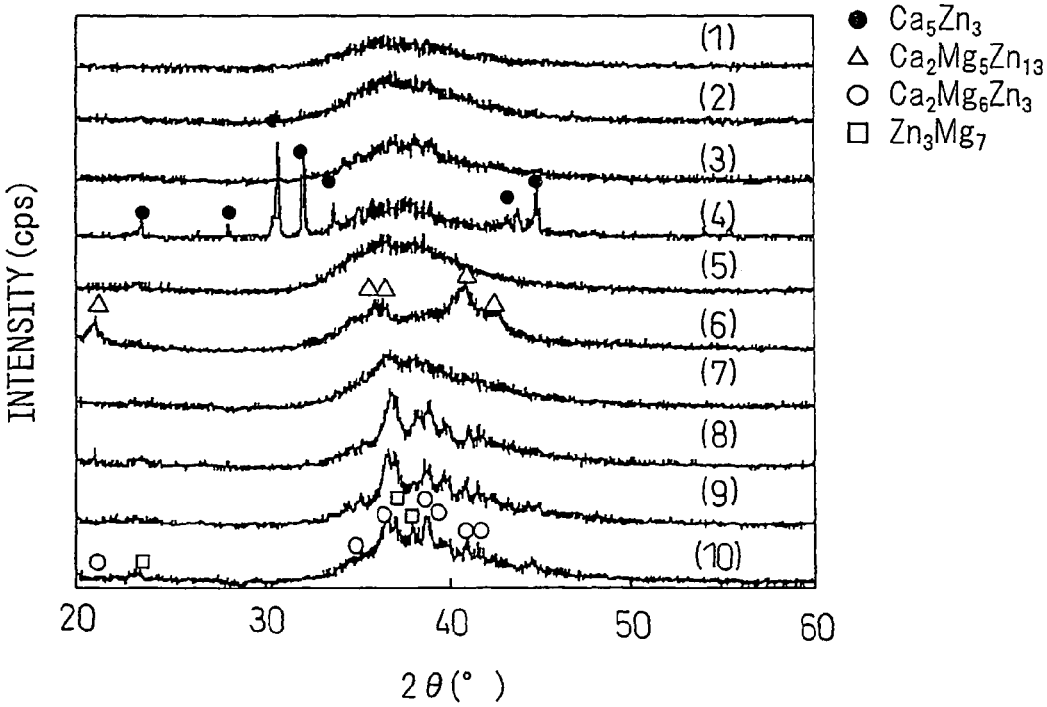
FIG. 6 is an X-ray diffraction chart of the Nos. (1) to (10) alloys of Table 7.

The formed phases of the rapidly cooled alloy surfaces were identified by X-ray diffraction. FIG. 6 shows the X-ray diffraction charts. Depending on the differences in thickness and cooling rates, some crystal phases were mixed in, but in each case a halo pattern was detected. Note that (1) to (10) in the figure show the X-ray diffraction charts of Nos. (1) to (10) in Table 7.

TABLE 7

| | A | | | | | | | B | | | C | | | Production | Tm | Tg | |
|---|---|---|---|---|---|---|---|---|---|---|---|---|---|---|---|---|---|
| No. | Ag | Al | Au | Cu | Ni | Si | Zn | Li | Mg | Sn | Ca | La | Y | method | (K) | (K) | Tg/Tm |
| (1) | | 1 | | | | | 30 | | 65 | | 4 | | | Water cooling | 633 | 335 | □(0.53) |
| (2) | | 3 | | | | | 29 | | 64 | | 4 | | | Water cooling | 633 | 335 | □(0.53) |
| (3) | | 5 | | | | | 28 | | 63 | | 4 | | | Water cooling | 633 | 335 | □(0.53) |
| (4) | | 7 | | | | | 27 | | 62 | | 4 | | | Water cooling | 623 | 330 | □(0.53) |
| (5) | | 1 | | | | | 32 | | 63 | | 4 | | | Water cooling | 633 | 335 | □(0.53) |
| (6) | | 8 | | | | | 28 | | 60 | | 4 | | | Water cooling | 643 | 341 | □(0.53) |
| (7) | | 1 | | | | | 35 | | 60 | | 4 | | | Water cooling | 643 | 347 | ◇(0.54) |
| (8) | | 1 | | | | | 40 | | 55 | | 4 | | | Water cooling | 643 | 347 | ◇(0.54) |
| (9) | | 2 | | | | | 39 | | 56 | | 3 | | | Water cooling | 643 | 347 | ◇(0.54) |
| (10) | | 2 | | | | | 46 | | 49 | | 5 | | | Water cooling | 673 | 370 | ◇(0.55) |

Example 8

Zn, Al, Mg, and Ca metal reagents (purity 99.9 mass % or more) were mixed and melted using a high frequency induction furnace in an Ar atmosphere at 600° C., then furnace cooled to obtain the alloys of the compositions shown in Table 8. These alloys were used as plating alloys.

Cold rolled steel plates (plate thickness 0.8 mm) were cut into 10 cm×10 cm samples, then plated by a batch type hot dip plating test apparatus made by Rhesca. The bath temperature of the plating bath was 500° C. Air wiping was used to adjust the amount of deposition, then the samples were immersed in water of 0° C.

The phase formed at the surface layer of the plating layer was analyzed by measuring the X-ray diffraction chart by an X-ray diffraction apparatus using Kα-X-rays of Cu. To confirm the presence of the amorphous phase, the plated steel material was cut along its cross-section, then was polished and etched and the plating layer of the surface was observed by an optical microscope (X1000).

For the amorphous volume fraction of the plating layer, two thin sections for transmission electron microscope use were taken at each of the positions of the thickness of the plating layer of the test piece divided into five equal parts, image analysis using a computer was used to measure the area ratios of the amorphous regions in each of the fields, and the average value of the area ratios of the amorphous regions in all fields were used as the amorphous volume fraction.

The fabricated plated steel plates were subjected to a cyclic corrosion test. The corrosion test consisted of 21 cycles of the method based on automobile standards (JASO M 609-91, 8 hours, wet/dry time ratio=50%). However, for the saltwater, 0.5% saltwater was used. The corrosion resistance was evaluated by corrosion thickness reduction converted from the density and the corrosion mass loss after corrosion.

Samples with a corrosion thickness reduction of less than 1 μm were evaluated as "◎", of 1 to 2 μm as "○", of 2 to 4 μm as "◇", and of 4 μm or more as "x". Table 8 shows the corrosion resistances of the fabricated alloy plated steel plates.

Figure 7:
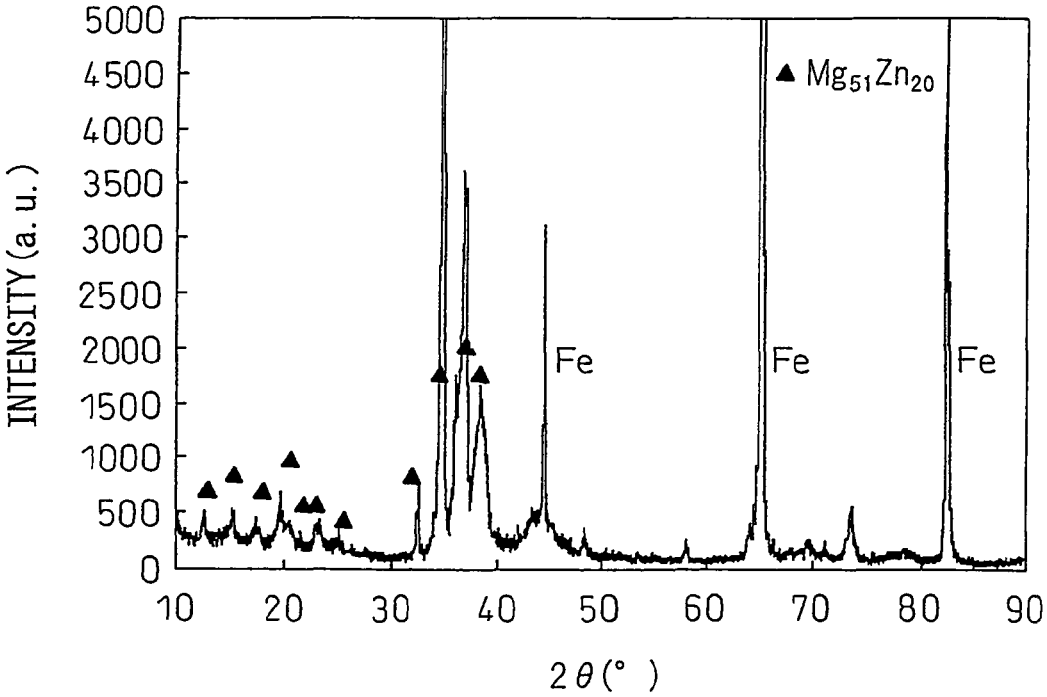
FIG. 7 is an X-ray diffraction chart of the No. (11) alloy of Table 8.

FIG. 7 shows an X-ray diffraction chart of No. (11) in Table 8. From the figure, it will be understood that the plating layer contains $Mg_{51}Zn_{20}$ (formed at the time of water cooling).

TABLE 8

| | A | | | | | | | B | | | C | | | Tm | Tg | | Amount of deposition | Amorphous phases volume fraction of plated | Production | Corrosion resistance |
|---|---|---|---|---|---|---|---|---|---|---|---|---|---|---|---|---|---|---|---|---|
| No. | Ag | Al | Au | Cu | Ni | Si | Zn | Li | Mg | Sn | Ca | La | Y | (K) | (K) | Tg/Tm | g/m$^2$ | layer | method | |
| (11) | | 5 | | | | | 23 | | 69.8 | | 2.2 | | | 623 | 336 | 0.54 | 25 | 14% | Water cooling | ○ |
| (12) | | 5 | | | | | 20 | | 73.0 | | 2 | | | 623 | 336 | 0.54 | 25 | 8% | Water cooling | ○ |

Industrial Applicability

By fabricating an alloy (invention alloy) by the composition of the present invention, a bulk metallic glass or amorphous alloy can be obtained from an alloy composition by which a bulk metallic glass or amorphous alloy could not be obtained in the past.

Up until now, with alloys with low amorphous forming abilities, even if amorphous phases could be obtained, the shapes were limited to powders or thin strips etc. Bulk metallic glass could not be fabricated.

By using the invention alloy, it becomes possible to obtain an alloy with a high glass forming ability and becomes possible to produce a bulk metallic glass by high pressure die-casting high in productivity and using a metal casting mold enabling production of bulk shapes.

According to the present invention, as stated above, a bulk metallic glass can be produced. Further, even in systems of components considered difficult to obtain an amorphous phase with in the past, an amorphous phase can be produced. Therefore, the present invention expands the applications of amorphous phases and contributes broadly to the development of industry.

For example, even in Al alloy plating, Zn alloy plating, and further Zn+Al alloy plating for which formation of an amorphous phase had been impossible in the past with hot dip plating, the alloy components of the present invention enables formation of an amorphous alloy plating layer even with hot dip plating.

The alloy of the present invention plating, with the same amount of deposition, is better in corrosion resistance than even hot dip galvanized steel plate. Further, the amorphous alloy plating, with the same amount of deposition, is better in corrosion resistance than even a crystalline alloy plating.

The alloy of the present invention plating can be widely applied to automobiles, buildings/housing, etc. It improves the lifetime of structural members and contributes to the effective utilization of resources, reduction of the environmental load, reduction of labor and costs in maintenance, etc. Therefore, the present invention greatly contributes to the growth of industry.

Further, an amorphous alloy plating has a better surface smoothness and higher light and heat reflectance compared with a crystalline plating. If using this for roofing and siding, the high level of its heat reflectance enables the rise in surface temperature to be prevented, so the rise in temperature indoors can be suppressed and a reduction of the insulation load and energy savings can be greatly contributed to.

The amorphous alloy plating of the present invention can be broadly applied addition to reflecting plates of electrical heaters, reflecting plates of high brightness lighting, and other members requiring a high reflectance. Through the improvement of the reflectance and the provision of reflecting materials less expensive than the past, the present invention greatly contributes to the growth of industry.

The invention claimed is:

1. A hot dip alloy-plated steel material having at least at part of its surface an alloy with a high amorphous phase forming ability as a hot dip plating layer, said hot dip alloy-plated steel material characterized in that said alloy with a high amorphous phase forming ability comprising at least two elements from a group of elements A with an atomic radius of less than 0.145 nm, and at least one element from each of a group of elements B with an atomic radius of 0.145 nm to less than 0.17 nm and a group of elements C with an atomic radius of 0.17 nm or more, said alloy characterized in that, a total content of elements belonging to the group of elements A is 40 to less than 64.7 atm %, a total content of elements belonging to the group of elements B is over 35 to 59.7 atm %, and a total content of elements belonging to the group of elements C is 0.3 to 15 atm %, when designating the elements with the greatest contents in the group of elements A, group of elements B, and group of elements C as respectively "element a", "element b", and "element c", and the element with the next greatest content in the group of elements A as "element a'", the ratio of the total of element a and element a' in the group of elements A is 70 atm % or more, the ratio of element b in the group of elements B is 70 atm % or more, and the ratio of element c in the group of elements C is 70 atm % or more, and a liquid forming enthalpy between any two elements selected from element a, element b, and element c is negative, wherein in said hot dip plating layer, a volume fraction of 5% or more is an amorphous phase, wherein said element a is Zn, and said element a' is Al, said element b is Mg, and said element c is Ca, and wherein said hot dip plating layer is characterized by containing said Zn (element a) and Al (element a') in a total amount of 40 to less than 64.7 atm %, Mg (element b) in over 35 to 59.7 atm %, and Ca (element c) in 0.3 to 15 atm %.

2. A hot dip alloy-plated steel material having at least at part of its surface an alloy with a high amorphous phase forming ability as a hot dip plating layer, said hot dip alloy-plated steel material characterized in that said alloy with a high amorphous phase forming ability comprising at least two elements from a group of elements A with an atomic radius of less than 0.145 nm, and at least one element from each of a group of elements B with an atomic radius of 0.145 nm to less than 0.17 nm and a group of elements C with an atomic radius of 0.17 nm or more, said alloy characterized in that, a total content of elements belonging to the group of elements A is 40 to 85%, a total content of elements belonging to the group of elements B is 10 to 55 atm %, and a total content of elements belonging to the group of elements C is 2 to 15 atm %, when designating the elements with the greatest contents in the group of elements A, group of elements B, and group of elements C as respectively "element a", "element b", and "element c", and the element with the next greatest content in the group of elements A as "element a'", the ratio of the total of element a and element a' in the group of elements A is 70atm % or more, the ratio of element b in the group of elements B is 70 atm % or more, and the ratio of element c in the group of elements C is 70 atm % or more, and a liquid forming enthalpy between any two elements selected from element a, element b, and element c is negative, wherein in said hot dip plating layer, a volume fraction of 5% or more is an amorphous phase, wherein said element a is Zn, and said element a' is Al, said element b is Mg, and said element c is Ca, and wherein said hot dip plating layer is characterized by containing said Zn (element a) and Al (element a') in a total amount of 40 to 85 atm %, Mg (element b) in 10 to 55 atm %, and Ca (element c) in 2 to 15 atm %.

3. A hot dip alloy-plated steel material having at least at part of its surface an alloy with a high amorphous phase forming ability as a hot dip plating layer, said hot dip alloy-plated steel material characterized in that said alloy with a high amorphous phase forming ability comprising at least two elements from a group of elements A with an atomic radius of less than 0.145 nm, and at least one element from each of a group of elements B with an atomic radius of 0.145 nm to less than 0.17 nm and a group of elements C with an atomic radius of 0.17 nm or more, said alloy characterized in that, a total content of elements belonging to the group of elements A is 40 to 70%, a total content of elements belonging to the group of elements B is 20 to 55 atm %, and a total content of elements belonging to the group of elements C is 2 to 15 atm %, when designating the elements with the greatest contents in the group of elements A, group of elements B, and group of elements C as respectively "element a", "element b", and "element c", and the element with the next greatest content in the group of elements A as "element a'", the ratio of the total of element a and element a' in the group of elements A is 70atm % or more, the ratio of element b in the group of elements B is 70 atm% or more, and the ratio of element c in the group of elements C is 70 atm % or more, and a liquid forming enthalpy between any two elements selected from element a, element b, and element c is negative, wherein in said hot dip plating layer, a volume fraction of 5% or more is an amorphous phase, wherein said element a is Zn, and said element a' is Al, said element b is Mg, and said element c is Ca, and wherein said hot dip plating layer is characterized by containing said Zn (element a) and Al (element a') in a total amount of 40 to 70 atm %, Mg (element b) in 20 to 55 atm %, and Ca (element c) in 2 to 15 atm %.

4. A hot dip alloy-plated steel material having at least at part of its surface an alloy with a high amorphous phase forming ability as a hot dip plating layer, said hot dip alloy-plated steel material characterized in that said alloy with a high amorphous phase forming ability comprising at least two elements from a group of elements A with an atomic radius of less than 0.145 nm, and at least one element from each of a group of elements B with an atomic radius of 0.145 nm to less than 0.17 nm and a group of elements C with an atomic radius of 0.17 nm or more, said alloy characterized in that, a total content of elements belonging to the group of elements A is 40 to less than 63%, a total content of elements belonging to the group of elements B is over 35 to 55 atm %, and a total content of elements belonging to the group of elements C is 2 to 15 atm %, when designating the elements with the greatest contents in the group of elements A, group of elements B, and group of elements C as respectively "element a", "element b", and "element c", and the element with the next greatest content in the group of elements A as "element a'", the ratio of the total of element a and element a' in the group of elements A is 70atm % or more, the ratio of element b in the group of elements B is 70 atm % or more, and the ratio of element c in the group of elements C is 70 atm % or more, and a liquid forming enthalpy between any two elements selected from element a, element b, and element c is negative, wherein in said hot dip plating layer, a volume fraction of 5% or more is an amorphous phase, wherein that said element a is Zn, and said element a' is Al, said element b is Mg, and said element c is Ca, and wherein said hot dip plating layer is characterized by containing said Zn (element a) and Al (element a') in a total amount of 40 to less than 63 atm %, Mg (element b) in over 35 to 55 atm %, and Ca (element c) in 2 to 15 atm %.

5. A hot dip alloy-plated steel material as set forth in any one of claims 1 to 4, characterized by further containing, as elements in said group of elements A, one or more elements selected from Au, Ag, Cu, and Ni in a total of 0.1 to 7 atm %.

6. A hot dip alloy-plated steel material as set forth in any one of claims 1 to 4, wherein said steel material is selected from the group consisting of Al-killed steel, ultralow carbon steel, high carbon steel, high strength steel, Ni, Cr-containing steel, hot rolled steel plate, cold rolled steel plate, and equal angle steel.

* * * * *

UNITED STATES PATENT AND TRADEMARK OFFICE

CERTIFICATE OF CORRECTION

PATENT NO. : 8,637,163 B2
APPLICATION NO. : 12/309391
DATED : January 28, 2014
INVENTOR(S) : Kohei Tokuda et al.

It is certified that error appears in the above-identified patent and that said Letters Patent is hereby corrected as shown below:

In the Specification

Column 3, line 30, change "Japanese Patent Publication (A) No. 2005'-60805" to -- Japanese Patent Publication (A) No. 2005-60805 --;

Column 4, line 28, change "–0.145 nm" to -- 0.145 nm --; and

Column 10, line 1, change "(of Zn" to -- of Zn --.

Signed and Sealed this
Twenty-third Day of September, 2014

Michelle K. Lee

Michelle K. Lee
*Deputy Director of the United States Patent and Trademark Office*